US008734612B2

(12) United States Patent
Leite

(10) Patent No.: US 8,734,612 B2
(45) Date of Patent: May 27, 2014

(54) METHOD AND SYSTEM FOR HIGH ALPHA DISSOLVING PULP PRODUCTION

(75) Inventor: Marcelo Moreira Leite, Salvado (BR)

(73) Assignee: Bahia Specialty Cellulose (BR)

( * ) Notice: Subject to any disclaimer, the term of this patent is extended or adjusted under 35 U.S.C. 154(b) by 0 days.

(21) Appl. No.: 12/789,307

(22) Filed: May 27, 2010

(65) Prior Publication Data

US 2011/0272110 A1 Nov. 10, 2011

(30) Foreign Application Priority Data

May 6, 2010 (KR) ..... 10-2010-0042681

(51) Int. Cl.

| | |
|---|---|
| ***D21C 1/02*** | (2006.01) |
| ***D21C 1/04*** | (2006.01) |
| ***D21C 3/02*** | (2006.01) |
| ***D21C 9/00*** | (2006.01) |
| ***D21C 11/00*** | (2006.01) |

(52) U.S. Cl.

CPC ..... *D21C 11/0007* (2013.01); *D21C 1/04* (2013.01); *D21C 9/004* (2013.01); *D21C 1/02* (2013.01); *D21C 3/02* (2013.01)

USPC ..... 162/90

(58) Field of Classification Search

CPC ..... D21C 1/02; D21C 1/04; D21C 3/02; D21C 9/002; D21C 9/004; D21C 9/083; D21C 11/04; D21C 11/0007

USPC ..... 162/29, 90

See application file for complete search history.

(56) References Cited

U.S. PATENT DOCUMENTS

| | | | | |
|---|---|---|---|---|
| 2,882,965 | A * | 4/1959 | Wayman et al. | 162/89 |
| 3,148,106 | A | 9/1964 | Mitchell et al. | |
| 3,988,198 | A * | 10/1976 | Wilson et al. | 162/30.1 |
| 4,507,172 | A | 3/1985 | Steltenkamp | |
| 5,053,108 | A | 10/1991 | Richter | |
| 5,080,755 | A | 1/1992 | Backlund | |
| 5,382,321 | A | 1/1995 | Fagerlind et al. | |
| 5,589,033 | A | 12/1996 | Tikka et al. | |
| 5,674,359 | A | 10/1997 | Chasse et al. | |
| 5,676,795 | A | 10/1997 | Wizani et al. | |

(Continued)

FOREIGN PATENT DOCUMENTS

| | | |
|---|---|---|
| EP | 0442806 | 8/1991 |
| EP | 0810321 | 12/1997 |

(Continued)

OTHER PUBLICATIONS

Gullichsen editor, Chemical Pulping 6A, 1999, Fapet Oy, p. A75.*

(Continued)

*Primary Examiner* — Anthony Calandra

(74) *Attorney, Agent, or Firm* — Irell & Manella LLP

(57) ABSTRACT

A method for pulp processing used in connection with a pre-hydrolysis kraft process (PHKP) includes adding wood chips or similar material to a reaction vessel, performing pre-hydrolysis, and neutralizing the mixture with a first quantity of white liquor followed by a different solution such as a cold caustic extraction alkaline filtrate optionally enriched with white liquor. The neutralization fluids are replaced with a cooking fluid comprising a hot black liquor and alkaline filtrate, optionally enriched with white liquor. The cooking fluid may have a relatively high effective alkali concentration. The cooked pulp may exhibit very low residual hemicelluloses and a kappa number within an optimal range.

42 Claims, 13 Drawing Sheets

(56) References Cited

U.S. PATENT DOCUMENTS

| | | | |
|---|---|---|---|
| 5,830,314 | A | 11/1998 | Mattsson |
| 6,057,438 | A | 5/2000 | Hyatt et al. |
| 6,086,712 | A | 7/2000 | Marcoccia et al. |
| 6,139,689 | A | 10/2000 | Polston et al. |
| 6,248,208 | B1 | 6/2001 | Henricson et al. |
| 6,346,167 | B2 | 2/2002 | Marcoccia et al. |
| 6,348,129 | B1 | 2/2002 | Colodette et al. |
| 6,506,283 | B2 | 1/2003 | Henricson et al. |
| 6,512,110 | B1 | 1/2003 | Heikkila et al. |
| 6,533,896 | B1 | 3/2003 | Tikka et al. |
| 6,835,828 | B2 | 12/2004 | Sears et al. |
| 6,896,810 | B2 | 5/2005 | Ali et al. |
| 7,056,418 | B2 | 6/2006 | Andoh et al. |
| 7,285,184 | B2 | 10/2007 | Li et al. |
| 7,670,678 | B2 | 3/2010 | Phan |
| 2002/0017370 | A1 | 2/2002 | Henricson et al. |
| 2002/0096276 | A1 | 7/2002 | Leithem et al. |
| 2004/0020854 | A1 | 2/2004 | Ali et al. |
| 2005/0203291 | A1 | 9/2005 | Svenson et al. |
| 2006/0070710 | A1 | 4/2006 | Hernesniemi et al. |
| 2009/0038033 | A1 | 2/2009 | Bloksberg et al. |
| 2009/0312536 | A1 | 12/2009 | Sixta et al. |

FOREIGN PATENT DOCUMENTS

| | | |
|---|---|---|
| EP | 1052326 | 11/2000 |
| JP | 2000220086 | 8/2000 |
| NZ | 215474 | 9/1986 |
| NZ | 223929 | 3/1990 |
| NZ | 236941 | 10/1993 |
| NZ | 237098 | 1/1994 |
| NZ | 243912 | 2/1994 |
| NZ | 242356 | 6/1994 |
| NZ | 278098 | 1/1998 |
| NZ | 314898 | 6/1998 |
| WO | 9520065 | 7/1995 |
| WO | 9523891 | 9/1995 |
| WO | 9532331 | 11/1995 |
| WO | 200236876 | 5/2002 |
| WO | 200242551 | 5/2002 |
| WO | 2003057979 | 7/2003 |
| WO | 2005064075 | 7/2005 |
| WO | 2006037860 | 4/2006 |
| WO | 2009013600 | 1/2009 |
| WO | 2009136000 | 1/2009 |

OTHER PUBLICATIONS

Handymath.com, Complete Sodium Hydroxide Density-Concentration Table calculator, downloaded online Dec. 16, 2011, downloaded from http://www.handymath.com.*

PCT International Search Report, mailed Mar. 28, 2011, PCT Patent Appln. No. PCT/IB2010/002311.

U.S. Congress, Office of Technology Assessment, "Technologies for Reducing Dioxin in the Manufacture of Bleached Wood Pulp", OTA-BP-O-54 (Washington, D.C.; U.S. Government Printing Office, May 1989).

"Examination Report" issued Jun. 22, 2010, New Zealand Patent Application No. 586177.

U.S. Congress, Office of Technology Assessment, Technologies for Reducing Dioxin in the Manufacture of Bleached Wood Pulp, OTA-BP-O-54 (Washington, DC: U.S. Government Printing Office, May 1989).

Analysis of Soda and Sulfate White and Green Liquors, T 624 cm-00, (c) 2000 TAPPI.

Walter Peter, et. al., Bacell's Solucell—A New Dissolving Pulp for High Quality Requirements, Lenzinger Berichte 78/98, pp. 28-32.

Grace editor, Pulp and Paper Manufacture: Alkaline Pulping, 1989, The Joint Textbook Committee of the Paper Industry, vol. 5 3rd edition, p. 101-103, 122, 502-511.

Industrial Cooking, Kai Henricson, Professor Pulping Technology, Lappeenranta University of Technology, Aug. 2004.

* cited by examiner

| Cook | H-factor | Cooking temp. C | pH-temp. C | Heat up to 120o.c, min | Heat up to 165o.c, min | Time at PH-temp, min | Total time min | Neutral, WL % EA NaOH | Neutral Temp. C | Neutral pH/g/l | WL charge % EA NaOH | EoC res. gEA/l NaOH | Remarks |
|---|---|---|---|---|---|---|---|---|---|---|---|---|---|
| K1/2709 | 394 | 160 | 165 | 30 | 60 | 40 | 130 | 12.0 | 154 | 10.2 | 11.0 | 26.7 | WL/WL |
| k1/2710 | 364 | 160 | 165 | 30 | 60 | 40 | 130 | 12.0 | 153 | 8.6 | 11.0 | 23.5 | CCE 54/WL |
| K1/2712 | 419 | 160 | 165 | 30 | 60 | 40 | 130 | 12.0 | 152 | 11.0 | 11.0 | 18.5 | CCE 54/CCE 54 |
| K1/2713 | 429 | 160 | 165 | 30 | 60 | 40 | 130 | 12.0 | 151 | 11.3 | 11.0 | 18.8 | WL 54/WL 54 |
| K1/2717 | 389 | 155 | 165 | 30 | 60 | 40 | 130 | 12.0 | 153 | 11.2 | 12.5 | 24.5 | CCE 60/CCE 60 |
| K1/2721 | 377 | 155 | 165 | 30 | 60 | 40 | 130 | 12.0 | 151 | 3.1 g/l | 13.0 | 29.5 | CCE 60/CCE 60 13 %EA High HBL |
| K1/2722 | 301 | 155 | 165 | 30 | 60 | 40 | 130 | 12.0 | 151 | 11.6 | 15.0 | 36.1 | CCE 70/CCE 70 15%EA |
| K1/2723 | 367 | 155 | 165 | 30 | 60 | 40 | 130 | 4 + 12 | 151 | 4.5 g/l | 11.0 | 31.7 | CCE 60 +WL pad/CCE 60 11%EA High HBL |

*FIG. 13A*

| Cook | Kappa | Viscosity ml/g | V/K ratio | Yield % | Reject % | Scr. Yield % | Solubility S10, % | Solubility S18, % | P factor | Remarks |
|---|---|---|---|---|---|---|---|---|---|---|
| K1/2709 | 10.3 | 988 | 96 | 39.3 | 0.13 | 39.1 | 3.6 | 2.7 | 310 | WL/WL |
| k1/2710 | 11.0 | 1059 | 96 | 40.3 | 0.16 | 40.2 | 4.0 | 3.1 | 300 | CCE 54/WL |
| K1/2712 | 10.8 | 1118 | 104 | 40.4 | 0.09 | 40.3 | 4.5 | 3.6 | 297 | CCE 54/CCE 54 |
| K1/2713 | 11.2 | 1158 | 103 | 40.2 | 0.12 | 40.0 | 3.7 | 3.1 | 300 | WL 54/WL 54 |
| K1/2717 | 11.4 | 1155 | 101 | 40.7 | 0.07 | 40.6 | 4.6 | 3.6 | 272 | CCE 60/CCE 60 |
| K1/2721 | 10.3 | 1107 | 107 | 40.1 | 0.09 | 40.0 | 4.1 | 3.1 | 301 | CCE 60/CCE 60 13 %EA High HBL |
| K1/2722 | 11.0 | 1119 | 102 | 40.0 | 0.13 | 39.9 | 4.0 | 2.9 | 304 | CCE 70/CCE 70 15%EA |
| K1/2723 | 9.7 | 1103 | 114 | 39.9 | 0.03 | 39.9 | 4.0 | 3.0 | 303 | CCE 60 +WL pad/CCE 60 11%EA High HBL |

*FIG. 13B*

METHOD AND SYSTEM FOR HIGH ALPHA DISSOLVING PULP PRODUCTION

BACKGROUND OF THE INVENTION

1) Field of the Invention

The field of the invention generally relates to pulp processing and, more specifically, to an improved method and system for treating effluents from cold caustic extraction in connection with a kraft chemical pulping process.

2) Background

Pulp from wood and plant materials has a large number of commercial uses. Although one of the most common uses is in paper manufacturing, pulp can also be used to produce a number of other products including rayon and other synthetic materials, as well as cellulose acetate and cellulose esters, which are used, for example, in the manufacture of filter tow, cloth, packaging films, and explosives.

A number of chemical and mechanical methods exist for processing wood and plant materials in order to manufacture pulp and paper. The basic processing steps include preparing the raw material (e.g., debarking and chipping), separating the wood fibers by mechanical or chemical means (e.g., grinding, refining or cooking) to separate the lignin and extractives from cellulose of the wood fibers, removing coloring agents by bleaching, and forming the resulting processed pulp into paper or other products. In addition to and in connection with pulp and paper manufacturing, paper mills also typically have facilities to produce and reclaim chemical agents, collect and process by-products to produce energy, and remove and treat wastes to minimize environmental impact.

"Pulping" generally refers to the process for achieving fiber separation. Wood and other plant materials comprise cellulose, hemicellulose, lignin and other minor components. Lignin is a network of polymers interspersed between individual fibers, and functions as an intercellular adhesive to cement individual wood fibers together. During the pulping process, lignin macromolecules are fragmented, thereby liberating the individual cellulosic fibers and dissolving impurities that may cause discoloration and future disintegration of the paper or other final product.

The kraft process is a commonly used pulping process. Paper produced from kraft pulping process can be used, for example, to make bleached boxboard and liner board used in the packaging industry. A conventional kraft process treats wood with an aqueous mixture of sodium hydroxide and sodium sulfide, known as "white liquor". The treatment breaks the linkage between lignin and cellulose, and degrades most of lignin and a portion of hemicellulose macromolecules into fragments that are soluble in strongly basic solutions. This process of liberating lignin from surrounding cellulose is known as delignification. The soluble portion is thereafter separated from the cellulose pulp.

FIG. 1 shows a flow diagram of a conventional kraft process 100. The process 100 involves feeding wood chips (or other organic pulp-containing raw materials) 118 and alkaline solutions into a high-pressure reaction vessel called a digester to effect delignification, in what is referred to as a "cooking" stage 121. The wood chips are combined with white liquors 111, which may be generated from downstream processes or provided from a separate source. Delignification may take several hours and the degree of delignification is expressed as the unitless "H factor", which is generally defined so that cooking for one hour in 100° C. is equivalent to an H factor of 1. Because of the high temperature, the reaction vessel is often pressurized due to the introduction of steam. Towards the end of the cooking step, the reaction vessel is reduced to atmospheric pressure, thereby releasing steam and volatiles.

The white liquor used in the cooking may be, for example, a caustic solution containing sodium hydroxide (NaOH) and sodium sulfide ($Na_2S$). The property of the white liquor is often expressed in terms of effective alkali (EA) and sulfidity. Effective alkali concentration may be calculated as the weight of sodium hydroxide plus one-half the weight of sodium sulfide, and represents the equivalent weight of sodium hydroxide per liter of liquor, expressed in gram per liter. Effective alkali charge as sodium hydroxide represents the equivalent weight of sodium hydroxide per oven-dried weight of wood, expressed in percentage. Sulfidity is the ratio of one-half the weight of sodium sulfide to the sum of the weight of sodium hydroxide and one-half the weight of sodium sulfide, expressed in percentage.

After cooking, a brown solid cellulosic pulp, also known as "brown stock," is released from the digester used in the cooking stage 121, and is then screened and washed in the washing and screening process 122. Screening separates the pulp from shives (bundles of wood fibers), knots (uncooked chips), dirt and other debris. Materials separated from the pulp are sometimes referred to as the "reject" and the pulp as the "accept." Multi-stage cascade operations are often utilized to reduce the amount of cellulosic fibers in the reject stream while maintaining high purity in the accept stream. Further fiber recovery may be achieved through a downstream refiner or reprocess of sieves and knots in the digester.

The brown stock may then be subject to several washing stages in series to separate the spent cooking liquors and dissolved materials from the cellulose fibers. The spent cooking liquor 112 from the digester employed in the cooking stage 121 and the liquor 113 collected from the washing and screening process 122 are commonly both referred to as "black liquor" because of their coloration. Black liquor generally contains lignin fragments, carbohydrates from the fragmented hemicelluclose and inorganics. Black liquor may be used in addition to white liquor in the cooking step, as illustrated for example in FIG. 1 by the arrow representing black liquor 113 produced in the washing and screening process 122 and transferred to the cooking stage 121. Black liquor 135 from an accumulator tank (not shown in FIG. 1) may also be fed to the digester as part of the cooking stage 121, if needed to achieve the appropriate alkaline concentration or for other similar purposes.

The cleaned brown stock pulp 131 from the washing and screening process 122 may then be blended with white liquor 114 and fed into a reaction vessel to further separate dissolved materials such as hemicellulose and low molecular weight cellulose from the longer cellulosic fibers. An exemplary separation method is the so-called cold caustic extraction ("CCE") method, and is represented by CCE reaction stage 123 in FIG. 1. The temperature at which the extraction is effected may vary but a typical range is less than 60° C.

The purified pulp 132 from the reactor used in the CCE reaction stage 123 is then separated from spent cold caustic solution and dissolved hemicellulose, and washed several times in a second washing and separation unit in a CCE washing stage 124. The resulting purified brown pulp 133 with relatively high alpha cellulose content, still containing some lignin, continues to a downstream bleaching unit for further delignification. In some pulp production processes, bleaching is performed before the CCE reaction stage 123 and the CCE washing stage 124.

It is desirable in a number of applications, such as the manufacture of synthetic materials or pharmaceutical products, to have pulp of very high purity or quality. Pulp quality can be evaluated by several parameters. For example, the percentage of alpha cellulose content expresses the relative purity of the processed pulp. The alpha cellulose content can be estimated and calculated based on the pulp solubility (e.g., S10 and S18 factors described below). The degrees of delignification and cellulose degradation are measured by Kappa Number ("KN") and pulp viscosity respectively. A higher pulp viscosity indicates longer cellulose chain length and lesser degradation. Standard 236 om-99 of the Technical Association of Pulp and Paper Industry (TAPPI) specifies a standard method for determining the Kappa number of pulp. The Kappa number is an indication of the lignin content or bleachability of pulp. Pulp solubility in 18 wt % sodium hydroxide aqueous solutions ("S18") provides an estimate on the amount of residual hemicellulose. Pulp solubility in 10 wt % sodium hydroxide aqueous solution ("S10") provides an indication on the total amounts of soluble matters in basic solutions, which include the sum of hemicellulose and degraded cellulose. Finally, the difference between S10 and S18 indicates the amount of alkali soluble fragmented cellulose.

Conventional techniques can achieve purified pulp with alpha cellulose content between 92 and 96 percent, although historically it has been quite difficult to reach purities in the upper end of that range, particularly while maintaining other required properties of the pulp like high viscosity (i.e., limited cellulose degradation resulting from the pulping process).

In a conventional process, the filtrate 116, also referred to as the CCE alkaline filtrate, from the CCE washing and separation stage 124 comprises both the spent cold caustic solution and the spent washing liquid from the washing and separation stage 124. This filtrate 116 often contains substantial amounts of high molecular hemicellulose. When filtrate with high hemicellulose content is recycled for use as part of the cooking liquor in the digester of the cooking stage 121, hemicellulose may precipitate out of the solution and deposit on the cellulosic fibers. This can prevent high quality pulp from being achieved. On the other hand, certain applications—such as high quality yarn or synthetic fabrics, materials for liquid crystal displays, products made with acetate derivatives, viscose products (such as tire cord and special fibers), filter tow segments used in cigarettes, and certain food and pharmaceutical applications—need pulps containing a minimal amount of redeposited hemicelluloses and a high alpha cellulose content.

As illustrated in FIG. 1, part of the CCE alkaline filtrate 116 has to be bled to the recovery area 134 in order to control the hemicelluloses redeposition in the cooking stage 121. The diverted CCE alkaline filtrate 116 sent to the recovery area 134 may be combined with excess black liquor, concentrated and combusted in a recovery boiler to consume the organics and recover inorganic salts. A new alkali source may then be needed to replace the CCE filtrate and black liquor sent to the recovery area 134 in order to maintain proper alkali balance in the cooking stage 121.

The conventional process does not provide an efficient or cost-effective means for achieving cellulose of suitable alpha content that may be needed for a variety of industrial, pharmaceutical and material uses including those identified above.

There exists a need for a pulp processing method and system that results in a dissolving pulp with very high alpha cellulose content. There further exists a need for a pulp processing method and system that provides an efficient and cost effective way for preparing high alphas dissolving pulp by preventing hemicelluloses redeposition.

SUMMARY OF THE INVENTION

In one aspect, an improved method and system for pulp manufacturing involves, among other things, enriching one or more of black liquor and cold caustic extraction (CCE) alkaline filtrate used in the cooking stage with white liquor.

According to one or more embodiments, a method and system for pulp manufacturing used in connection with a kraft process includes a cooking stage having the steps of feeding wood chips or other organic pulp-containing materials into a digester or similar reaction vessel, performing a sequency of sequential process phases: pre-hydrolysis, neutralizing the chips with a white liquor plus a CCE alkaline filtrate optionally enriched with white liquor, filling the digester with hot black liquor and/or a CCE alkaline filtrate (either or both enriched with a white liquor), and cooking for an amount of time effective to result in delignification. These steps may be followed with cold displacement and pulp discharge.

After the cooking stage, further steps may include treating a resulting brown stock to yield semi-purified pulp, extracting the semi-purified pulp with a caustic solution to yield a purified pulp and a solution containing hemicellulose, separating the hemicellulose-containing solution from the purified pulp, washing the purified pulp and collecting an alkaline filtrate resulting therefrom, and utilizing a significant portion of the alkaline filtrate (optionally concentrated by evaporation or other means) in the digester. The overall process may help prevent hemicelluloses deposition, improve the purity of high alpha dissolving pulp, and increase the efficiency of the overall pulp manufacturing system.

Further embodiments, alternatives and variations are also described herein or illustrated in the accompanying figures.

BRIEF DESCRIPTION OF THE DRAWINGS

FIGS. 13A and 13B are graphs summarizing various process conditions and results according to various examples of processes.

DETAILED DESCRIPTION OF PREFERRED EMBODIMENTS

Figure 1:
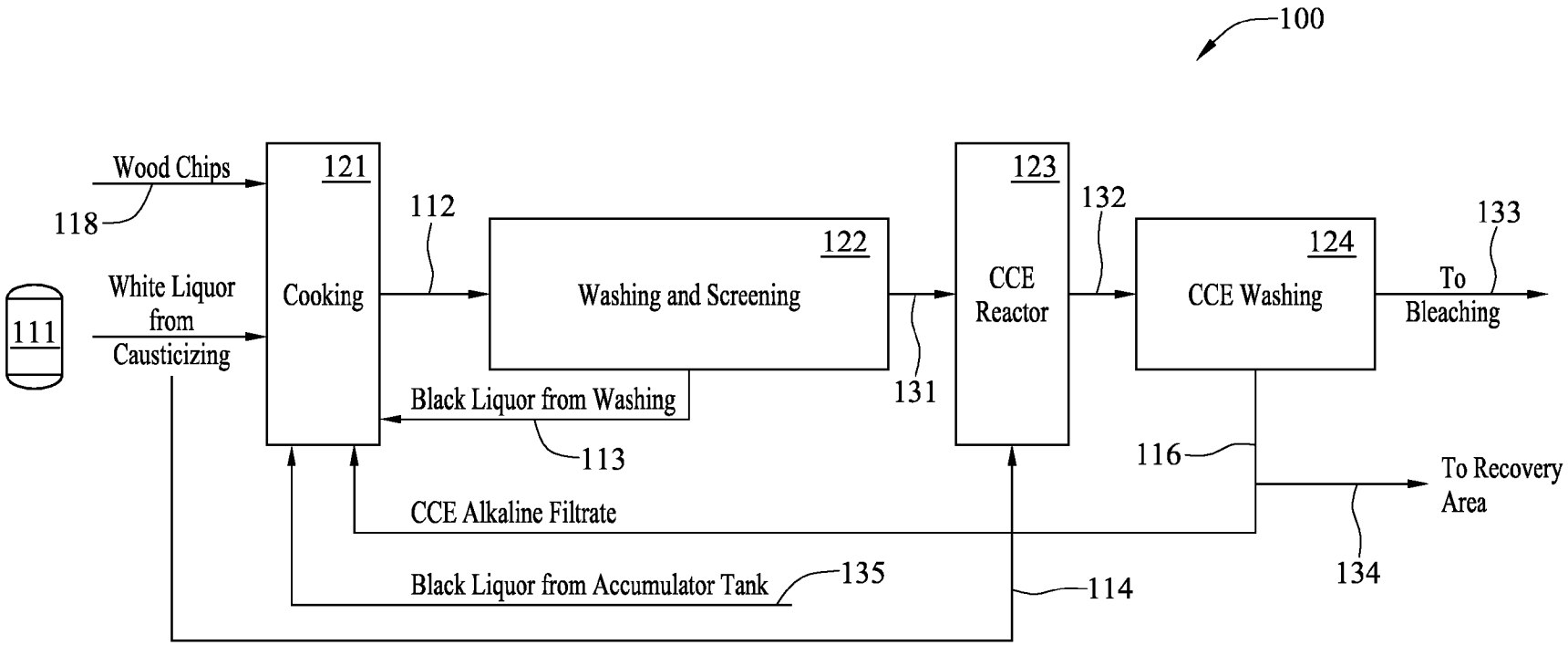
FIG. 1 (Prior Art)
FIG. 1 is a general process flow diagram of a conventional pre-hydrolysis kraft pulping process used in connection with pulp production, as generally known in the art.

According to one or more embodiments, a method and system for pulp processing used in connection with a kraft process involves combining a first caustic solution, such as white liquor, with a quantity of wood or other organic material containing raw pulp in an appropriate tank or reaction vessel (i.e., a digester) for cooking at a suitable temperature of, e.g., between 140 and 180° C. to yield a brown stock. Washing and screening of the brown stock results in semi-purified pulp as well as derivatives (such as black liquor) that are fed back to the digester. The semi-purified pulp may be extracted with another caustic solution (which again may be white liquor) at a suitable temperature of, e.g., below 50° C. to yield a purified pulp. Through additional washing, a hemicellulose-containing solution may be separated from the purified pulp, resulting in another caustic solution in the form of a cold caustic extraction (CCE) alkaline filtrate that can be separately collected and stored. This CCE alkaline filtrate may be concentrated by, e.g., evaporation or other means, and used by itself or in combination with the first caustic solution in the digester to treat the organic materials and re-start the cycle. In other embodiments, the CCE alkaline filtrate is returned in significant portion to the digester, but without undergoing concentration.

According to an aspect of one or more embodiments, wood chips or other pulp-containing organics are reacted with a caustic solution in a reaction vessel as part of a cooking stage. The cooking stage preferably involves feeding wood chips or other organic pulp-containing materials into a digester or similar reaction vessel, performing pre-hydrolysis, neutralizing the mixture with a white liquor plus a CCE alkaline filtrate optionally enriched with a white liquor, filling the digester with hot black liquor and CCE alkaline filtrate (either or both preferably being enriched with white liquor), and cooking for an amount of time effective to result in delignification. These steps may be followed with cold displacement and pulp discharge.

The discharged pulp mixture generally contains liberated cellulosic fibers. These fibers may be further extracted with another caustic solution to dissolve hemicellulose. The spent caustic solution together with dissolved hemicellulose may be separated from the extracted pulp, and the pulp subject to further washing to remove residual caustic solution and hemicellulose. The washing liquids and the spent caustic solution containing hemicellulose are combined and optionally concentrated to form a concentrated CCE filtrate. The concentrated or unconcentrated CCE filtrate, as the case may be, may then be used singularly or in combination with another caustic solution to treat wood in the reaction vessel.

In this manner, potentially the entire amount of the alkaline filtrate generated in the washing and cleaning step may be returned and used as an alkali source in the pre-hydrolysis kraft (PHK) cooking process, thereby helping prevent hemicelluloses deposition and improving the purity of high alpha dissolving pulp. All steps outlined above may be carried out with traditional equipment.

Figure 2:
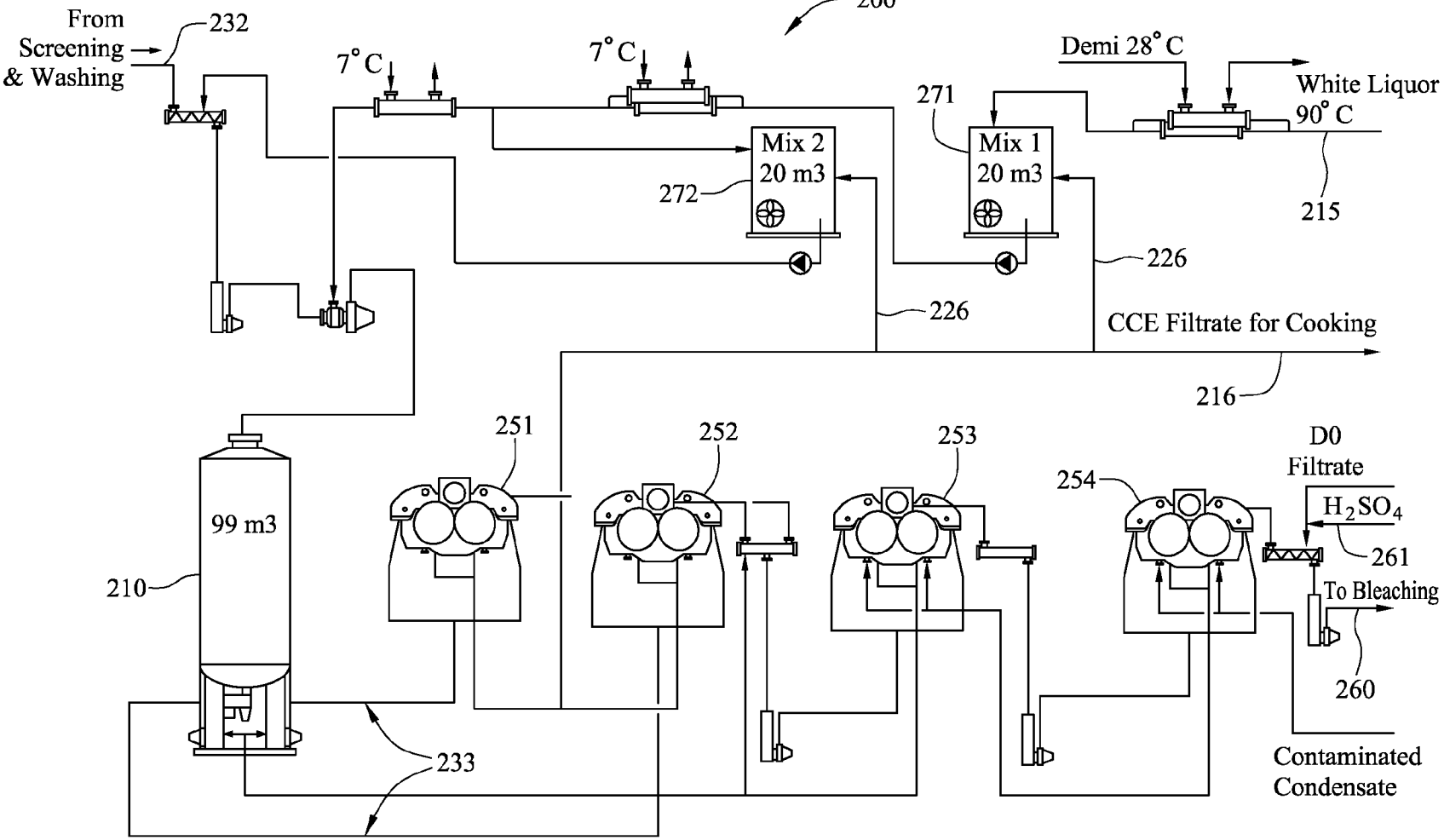
FIG. 2 is a diagram of a conventional system and related process for washing and cleaning pulp in connection with a cold caustic extraction process.
Figure 3:
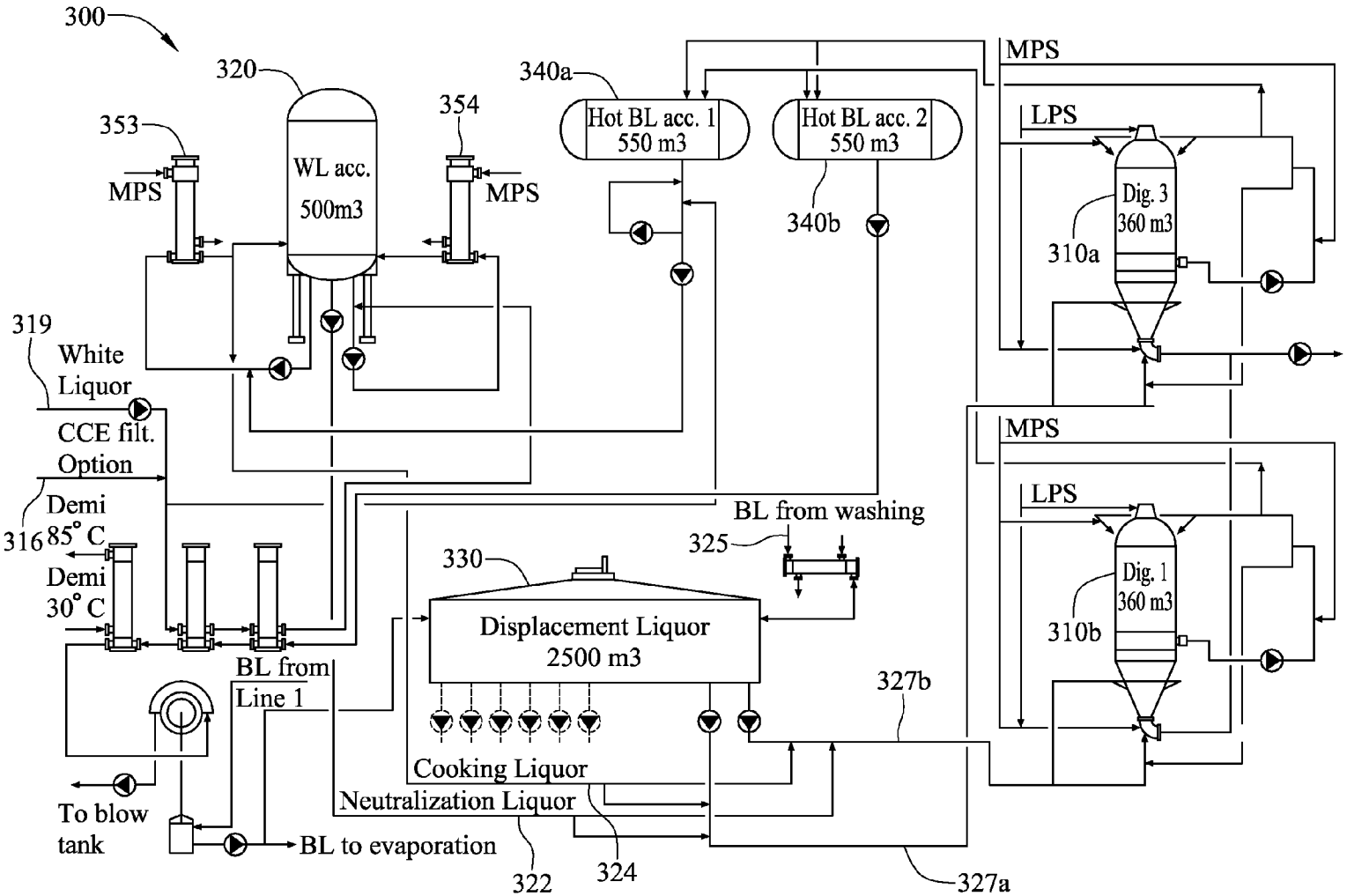
FIG. 3 is a diagram of a conventional system and related process for a cooking as may be used in a pre-hydrolysis kraft pulping process.

For comparative purposes, FIGS. 2 and 3 show certain relevant aspects of a pre-existing process in accordance with the general pulp manufacturing technique illustrated in FIG. 1. Shown in FIG. 2 is a pre-existing system and related process for washing and cleaning pulp, and shown in FIG. 3 is a pre-existing system and related process for a cooking, all as may be used in a pre-hydrolysis kraft pulping process. With reference first to FIG. 2, a system 200 and related process for washing and cleaning pulp involves transporting a purified pulp 232 from the brown stock washing and screening (i.e., stage 122 in FIG. 1) via a suitable conveyance to the CCE reactor 210 (i.e., stage 123 in FIG. 1), along with a mixture of white liquor 215 that is cooled, CCE alkaline filtrate 226, or possibly other fluids or solutions which may be temporarily stored in one or more mixing tanks 271, 272. From the CCE reactor 210, the pulp mixture 233 may be provided to a battery of twin roll press units 251-254, which are used as part of the washing and cleaning of the pulp. After treatment using the twin roll press units 251-254, the treated pulp 260 may then be further treated or mixed with sulphuric acid ($H_2SO_4$) 261 and/or other liquid and passed downstream to a bleaching process. In connection with the washing process, CCE alkaline filtrate 216 extracted from the twin roll press units 251-254 may be collected and used for various purposes, including returned and recycled upstream for use in the cooking stage.

As previously noted, a portion of the CCE alkaline filtrate 216, usually much less than half, is typically bled off to a recovery area or otherwise removed.

FIG. 3 illustrates a system 300 and related process for a cooking as conventionally known in which the CCE alkaline filtrate may optionally be used. In FIG. 3, one or more digesters 310*a*, 310*b* are fed wood chips or other cellulose-containing organic material, and are the basic reaction vessels used in the cooking process. The system 300 also includes a white liquor tank 320, a displacement liquor tank 330, and one or more hot black liquor accumulator tanks 340*a*, 340*b*. White liquor 319 from an external source may be pumped into the white liquor tank 320, from which it may be drawn and used as a neutralization liquor 322 in the digesters 310*a*, 310*b*. The displacement liquor tank 330 holds a solution that may comprise diluted black liquor or a mixture including black liquor, as may be obtained for example as a by-product from the brown stock washing stage, as indicated by the incoming arrow 325.

The white liquor 319 or CCE filtrate 316 may be pumped through several heat exchangers to the suction side of the pump associated with white liquor tank 320. Another pump sends white liquor or CCE filtrate for the neutralization stage to the discharge side of the pump associated with the displacement liquor tank 330. During hot black liquor fill, the liquor from hot black liquor accumulator tank 340*a* is pumped through heat exchanger 353 and eventually to the digesters 310*a*, 310*b* via cooking liquor pipeline 324. After the hot black liquor fill comes the while liquor fill (or CCE filtrate) through the same pump and same line as the hot black liquor fill. When the cooking is finished, the displacement liquor 327*a*, 327*b* is fed to the digesters 310*a*, 310*b* and used in the at the end of the cooking stage. The hottest part of the displacement is sent to the first hot black liquor accumulator tank 340*a* to be used in the next cook, and the cooler part is sent to the second hot black liquor accumulator tank 340*b*. From the second hot black liquor accumulator tank 340*b* the liquor is sent to an evaporation plant through the heat exchangers and a liquor filter, and from there to a recovery boiler where the organics are burned to produce steam while the inorganics are recovered.

In general, when high purity pulp is not being produced a cold caustic extraction stage may not be needed and while liquor may be fed directly to the digesters 310*a*, 310*b*. When cold caustic extraction is employed, the CCE filtrate is generally pumped back into the digesters 310*a*, 310*b*.

In typical cooking processes, the digesters 310*a*, 310*b* are filled with wood chips or similar organic material and then subjected to a pre-hydrolysis process. After pre-hydrolysis, a neutralization liquor 322 is provided to the digesters 310*a*, 310*b*, which is then displaced in sequence by an appropriate cooking liquor. The temperature of the digesters 310*a*, 310*b* is then raised to a cooking temperature at which they are maintained for a sufficient period of time for delignification to occur. When cooking is complete, a blow valve in each digester 310*a*, 310*b* is opened, and the delignified pulp from the digester is then discharged into a blow tank (not shown). Towards the end of a cooking cycle, the digester is kept pressurized while a displacement liquid is introduced to displace the hot black or spent liquors, which are released out of the digester 310*a*, 310*b* while still roughly at the temperature used for cooking. In a typical process, the displacement fluid constitutes a filtrate obtained from washing the brown stock pulp. The displaced hot black liquor is collected in one or more high temperature accumulators 340*a*, 340*b* for subsequent reuse. After the displacement process, the displacement liquid and remaining spent black liquor, which are cooler than the normal cooking temperature, may optionally also be stored in a low temperature accumulator and sent to the recovery area. The digesters 310*a*, 310*b* are eventually drained to remove the delignified pulp.

Figure 4:
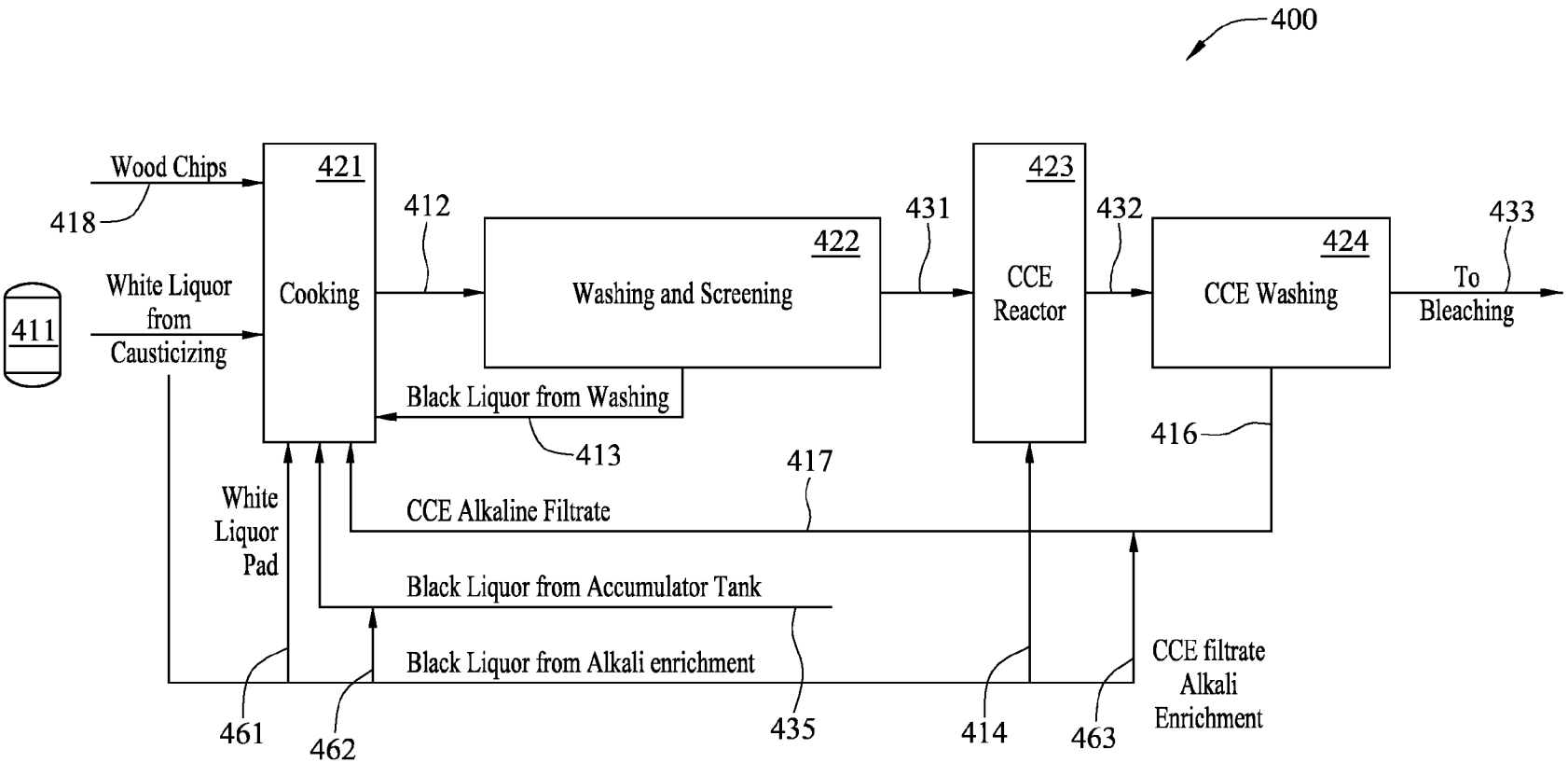
FIG. 4 is a general process flow diagram of a system and related process for pulp production process in accordance with one embodiment as disclosed herein.

FIG. 4 is a general process flow diagram of a process 400 for pulp production process in accordance with one embodiment as disclosed herein, in which the cooking process is modified and improved over the conventional technique. The process 400 in FIG. 4 begins with a cooking stage 421 in which, generally similar to a conventional kraft process, wood chips or other pulp-containing organic materials 418 are fed into a digester capable of withstanding high pressure. The digester may be of any suitable volume such as, for example, approximately 360 cubic meters. The particular choice of wood type or other plant or organic materials may depend upon the desired end products. For example, soft woods such as pine, fir and spruce may be used for some derivatization processes to obtain products with high viscosity, like cellulose ethers (which may be used, for example, as additives in food, paint, oil recovery fluids or muds, paper, cosmetics, pharmaceuticals, adhesives, printing, agriculture, ceramics, textiles, detergents and building materials). Hardwoods, such as eucalyptus and acacia may be preferred for those applications that not require a pulp with very high viscosity.

In one embodiment, and as described in further detail below, the digester is heated during the pre-hydrolysis portion of the cooking stage 421 to a first pre-determined temperature with steam or other appropriate means. This pre-determined temperature may, for example, be between 110 to 130° C. and, more specifically, may be approximately 120° C. The heating in this particular example is effected over a period of time between 15 to 60 minutes (e.g., 30 minutes), although other heating times may be used depending upon the particulars of the equipment and the nature of the organic materials being heated.

The digester is preferably then further heated by steam or other means to a second temperature above the first pre-determined temperature for a pre-hydrolysis stage. This second pre-hydrolysis temperature is preferably around 165° C., although again the precise temperature may depend upon a number of variables including the equipment and organic materials. The heating for pre-hydrolysis may be effected over a period of 30 to 120 minutes (e.g., 60 minutes), although again the heating time may vary as needed. Once the pre-hydrolysis temperature is attained, the digester is held at that temperature for a suitable period of time, e.g., 35 to 45 minutes, or any other time sufficient to complete pre-hydrolysis.

In a preferred embodiment, a neutralization solution is added to digester as part of the cooking stage 421. The neutralization solution may be composed of a white liquor 411, an alkaline filtrate 417, or a mixture thereof. A white liquor may take the form of, e.g., a mixture of sodium hydroxide and sodium sulfide. In a preferred embodiment, the white liquor has between 85 to 150 grams per liter effective alkali as sodium hydroxide (NaOH), more preferably between 95 to 125 grams NaOH per liter effective alkali, and most preferably between 100 to 110 grams NaOH per liter of effective alkali. The sulfidity of the white liquor may have a range between 10% and 40%, preferably between 15 and 35%, and most preferably between 20 and 30%.

The concentration of effective NaOH in the black liquor 435 used for hot liquor fill before enrichment with white liquor may be between 15 to 35 grams per liter and is preferably in the range of 20 to 30 grams per liter, or in the alkaline filtrate 417 after enrichment with white liquor may be between 35 to 75 grams per liter and is preferably in the range of 40 to 50 grams per liter, although it may vary according to the particular process.

The neutralization solution may be added to the digester in one portion or else may be added to the digester in several portions. In one embodiment, the neutralizing solution comprising of both a white liquor and alkaline filtrate is added in two portions, whereby the white liquor is first provided to the digester as a white liquor pad 461 followed by addition of the CCE alkaline filtrate 417. In one embodiment, the neutralization solution is added at a temperature between 120 to 160° C., and more preferably between 140 to 150° C. The white liquor may comprise between 20% and 40% of the total effective alkali charge in the neutralization step, and more preferably may comprise between 25% and 30% of the total effective alkali charge in neutralization.

A cooking liquor then may displace the neutralization liquor in digester and is used for cooking the wood in the digester. The cooking liquor may be added to the digester in several portions. In one embodiment, the cooking solution comprising of both a hot black liquor and a white liquor or CCE alkaline filtrate added in two portions. The range and preferred range of sodium hydroxide and sodium sulfide in the black liquor, white liquor and CCE filtrate solutions may be the same as those for the neutralization phase.

In one or more embodiments, the cooking solution includes one or both of the following elements: (i) a black liquor 435 with an effective alkali concentration of 15 to 35 grams per liter as NaOH, optionally enhanced with an added amount of white liquor 462 with an effective alkali concentration of 95 to 125 grams per liter as NaOH to achieve an effective alkali concentration of 40 to 50 grams per liter as NaOH or else enhanced with an added amount of recycled CCE filtrate 417

(optionally concentrated to increase alkali level or enriched with white liquor); and (ii) a CCE alkaline filtrate 417 derived from a downstream cold caustic extraction washing stage 424 with an effective alkali concentration of 55 to 75 grams per liter as NaOH, after enrichment or enhancement with added white liquor 463, and optionally concentrated by evaporation or other similar means.

The digester may be heated to the cooking temperature with steam or other means. The cooking temperature may be in the range between 140 and 180° C., and is preferably in the range between 145 to 160° C. The heating can be over a period of 10 to 30 minutes or other suitable period. The digester is then held at the cooking temperature for a suitable period for the cooking process, such as between 15 to 120 minutes. The temperature range and the cooking time are chosen for target H factor, which is preferably in the range of between 130 and 250.

As a result of the cooking stage 421, a brown stock 412 is produced. The brown stock 412 is provided to a washing and screening process 422, similar to a conventional kraft procedure, whereupon the brown stock 412 is screened through the use of different types of sieves or screens and centrifugal cleaning. The brown stock 412 is then washed with a washer in the screening and washing process 422. The washer may be of any commercial type, including horizontal belt washers, rotary drum washers, vacuum filters, wash presses, compaction baffle filters, atmospheric diffusers and pressure diffusers. The washing unit may use counter current flow between the stages so that pulp moves in the opposite direction to the washing waters. In one embodiment, pressurized water is used to wash the brown stock 412. In another embodiment, a diluted caustic solution is used to wash the brown stock 412. The diluted caustic solution may, for example, have an effective alkali concentration of less than 5 grams NaOH per liter, more preferably of less than 1 gram NaOH per liter. The spent washing liquor is collected and used as black liquor 413 elsewhere in the process 400. In one embodiment, the black liquor 413 is used as part of the displacement liquor provided to the digester at the end of the cooking stage 421.

The semi-purified pulp from the washing and screening process 422 is then pumped as a slurry to a reactor which is employed in cold caustic extraction ("CCE") stage 423, again similar to the conventional method, in which the semi-purified pulp is mixed with a second caustic solution 414 (which may be the same or different from the first caustic solution 411) to effect further separation of hemicellulose from the desired cellulosic fibers. Cold caustic extraction is a process well known in the art. Examples of cold caustic treatment processes and systems are described in greater detail, for instance, in Ali et al., U.S. Patent Publication No. 2004/0020854, and Svenson et al., U.S. Patent Publication No. 2005/0203291, both of which are hereby incorporated by reference as if set forth fully herein.

The caustic solution 414 used in the blending and extraction procedures of the CCE extraction process 423 may comprise freshly prepared sodium hydroxide solutions, recovery from the downstream process, or by-products in a pulp or paper mill operation, e.g., concentrated CCE filtrate, white liquor and the like. Other basic solutions, such as ammonium hydroxide and potassium hydroxide, may also be employed. Cold alkali extraction may be performed with additional chemicals added such as hydrogen peroxide, sodium hypochlorite, sodium borohydride, and surfactants.

After the desired dwell time, the pulp is separated from the spent cold caustic solution in a following washing process 424. The spent cold caustic solution contains extracted hemicellulose. The pulp is washed in CCE washing unit. Exemplary washers include horizontal belt washers, rotary drum washers, vacuum filters, wash presses, compaction baffle filters, atmospheric diffusers and pressure diffusers. The washing liquid may comprise, for example, pure water or diluted caustic solution with an effective alkali concentration of, e.g., below 1 gram NaOH per liter. The spent washing liquid is collected in a conventional manner and can be combined with spent cold caustic solution to form another caustic solution 416 which, in one aspect, comprises an alkaline filtrate resulting from the washing process 424. The extracted and washed pulp 433 is, in the meantime, transported to the next stage for bleaching.

The CCE alkaline filtrate 416 may be provided in whole or part to a concentrating process, and may, for example, be fed into an evaporation system for concentration, although in other embodiments the CCE alkaline filtrate 416 is not subject to a concentration process. A typical evaporation system may contain several units or effects installed in series. The liquid moves through each effect and becomes more concentrated at the outlet of the effect. Vacuum may be applied to facilitate the evaporation and concentration of solutions. In connection with the concentrating process, a weak black liquor may also be concentrated into a strong black liquor by, e.g., evaporation using one or more effects in sequential arrangement, gradually increasing the concentration of the weak black liquor during the process. The strong black liquor may be stored in an accumulation tank and used in the recovery boiler generating steam and power, thus increasing efficiency through the reuse or recycling of output by-products. One technique for concentrating CCE alkaline filtrate for reuse in the cooking stage is described in copending U.S. application Ser. No. 12/789,265 filed concurrently herewith and entitled "Method and System for Pulp Processing Using Cold Caustic Extraction with Alkaline Filtrate Reuse," assigned to the assignee of the present invention, and hereby incorporated by reference as if set forth fully herein.

The concentrated alkaline filtrate solution 417 may be reused, in whole or part, in the cooking stage 421 as either part of neutralization liquor and/or as part of the cooking liquor. As noted earlier, the CCE alkaline filtrate 416 may be combined with a white liquor 463 for use as part of the cooking liquor. In certain embodiments, the concentrated CCE alkaline filtrate solution 417 may be used without enrichment from white liquor.

Concentrated alkaline filtrate solution 417 that is not reused in the cooking stage 421 may be used for other purposes. For example, it may optionally be diverted for other purposes, such as use on an adjacent production line (as white liquor). The concentrated alkaline filtrate solution 417 may also allow the use of higher liquor concentrations in the cooking stage 421, thus preventing re-deposition of hemicelluloses on the fibers.

Figure 5:
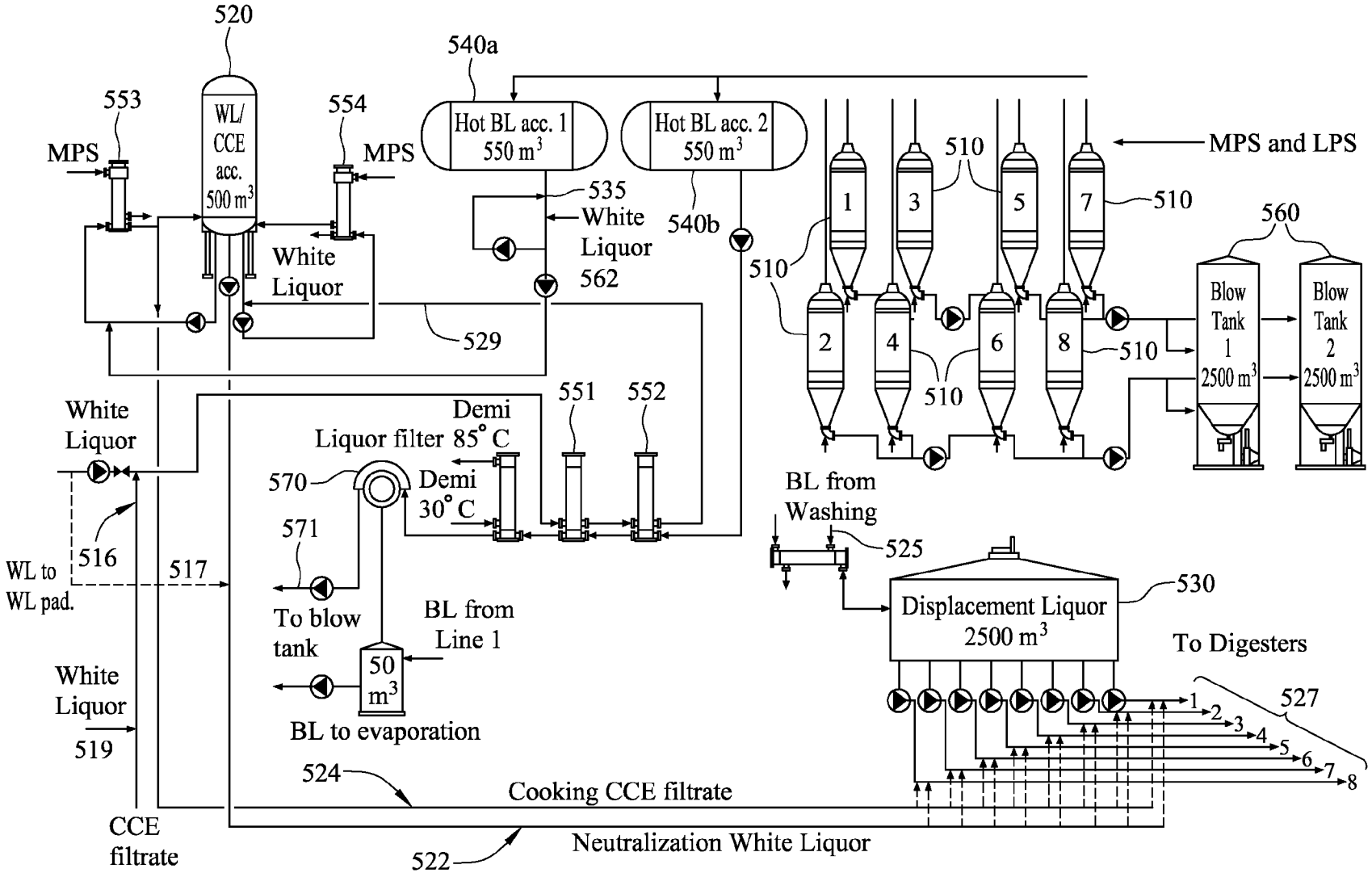
FIG. 5 is a diagram of a system and related process for a cooking stage used in connection with a pulp production process, in accordance with one embodiment as disclosed herein.

FIG. 5 is a diagram of a system 500 and related process for a cooking stage used in connection with a pulp production process, in accordance with one embodiment as disclosed herein. In FIG. 5, one or more digesters 510 (in this example, eight digesters) are, similar to the conventional process, fed wood chips or other pulp-containing organic material, and serve as the basic reaction vessels used in the cooking process. The system 500 also includes, among other things, a white liquor/CCE filtrate holding tank 520, a displacement liquor tank 530, one or more hot black liquor accumulator tanks 540*a*, 540*b*, and one or more blow tanks 560. White liquor 519 from a suitable source may be heated by fluid heaters 551, 552 and pumped into the white liquor/CCE filtrate holding tank 520, where it may be re-circulated and stored for later use, and from which it may be drawn and used as a neutralization liquor 522 in the digesters 510. CCE filtrate 516 may likewise be heated and pumped into the white liquor/CCE filtrate holding tank 520 for later use. The displacement liquor tank 530 holds a solution that may comprise diluted black liquor or a mixture including black liquor, which may be, for example, a by-product from the washing stage 424, as indicated by the incoming arrow 525.

At the end of the cooking process, cold liquor (75-85° C.) from the displacement liquor tank 530 is sent to the digester 510 in order to end the cooking reaction. The first part of the liquor displaced from the digester 510 is relatively hot (140-160° C.) and is sent to the first hot black liquor accumulator tank 540*a* for use in the next cook. The colder liquor displaced next from the digester 510 is cooler (about 120-140° C.) and is sent to the second hot black liquor accumulator tank 540*b*. From the second hot black liquor accumulator tank 540*b*, the hot black liquor 536 is pumped through heat exchangers to a liquor filter 570. The black liquor is cooled down while at the same time its heat is used to warm up the white liquor or CCE filtrate circulating through the heat exchangers 551, 552. From there, the filtered black liquor is sent to an evaporation plant for further processing.

In a preferred cooking process illustrated in FIG. 5, the digesters 510 are filled with wood chips or similar organic material. Pre-hydrolysis is carried out with steam, after which a neutralization white liquor 517 in the form of a white liquor "pad" is provided to the digesters 510 followed by introduction of a CCE alkaline filtrate 516 as part of the neutralization fluid 522. The neutralization fluid is then displaced by an appropriate cooking liquor. The cooking liquor may include (i) a CCE filtrate 524 from the white liquor/CCE filtrate holding tank 520 especially prepared for cooking; (ii) a black liquor 535 from the black liquor accumulator tank 540*a*, optionally enhanced with an added amount of white liquor (or CCE filtrate) 562 and, in this example, circulated through fluid heater 553 for controlling its temperature; and/or (iii) a CCE alkaline filtrate 516 derived from a downstream cold caustic extraction washing stage 424 (see FIG. 4), either concentrated or not through evaporation or other similar means, and optionally enhanced or enriched with added white liquor 519 to produce a white liquor-enriched concentrated CCE alkaline filtrate. The CCE alkaline filtrate 516 is pumped into the white liquor holding tank 520 through heat exchangers 551, 552 to be used in the neutralization phase as neutralization fluid 522 or in the cooking phase a cooking CCE filtrate 524. Preferred concentrations of the various cooking liquors are described elsewhere herein.

Once the cooking liquor(s) are added to the digesters 510, the temperature of the digesters 510 is raised to a cooking temperature at which the digesters are maintained for a sufficient period of time for delignification to occur. When cooking is complete, a blow valve in each digester 510 is opened, and the delignified pulp from the digester 510 is then discharged into one of the blow tanks 560. Towards the end of a cooking cycle, the digester is kept pressurized while a displacement liquor from the displacement liquor tank 530 is introduced to displace the hot black or spent liquors, which are released out of the digesters 510 while still roughly at the temperature used for cooking. The displacement liquor, as noted, generally comprises a black liquor or similar filtrate obtained from washing the pulp or delignified fibers during pulp production of prior batches. The displaced hot black liquor is collected in one or more high temperature accumulators 540 for subsequent reuse.

The digesters 510 are eventually drained to remove the delignified pulp. The hot black liquor previously drained from the digester 510 may be reused (and mixed with other solutions or filtrates, such as hot white liquor).

Various aspects of the overall cooking process may be explained by further reference to FIGS. 6-9. FIGS. 6A and 6B are cross-sectional diagrams of a digester (such as any of digesters 510 illustrated in FIG. 5) depicting, among other things, a typical liquor and material level as used in a pre-existing process for a neutralization step. FIGS. 7A-7C, 8 and 9 are also cross-sectional diagrams of a digester depicting liquor and material mixtures during neutralization prior to cooking in accordance with one or more embodiments as disclosed herein. First as shown in FIG. 6A, a digester 610 during the neutralization step of a known cooking process may be filled after pre-hydrolysis with a substantial amount of CCE filtrate (liquor) 616 representing a significant percentage (e.g., 60%) of the total volume of the digester 610. For example, for a digester with a capacity of 360 cubic meters and a charge of 72 tons of wood (dry-weight) and 11 tons of dissolved solids, about 214 cubic meters of CCE filtrate 616 may be used as part of the neutralization phase. During this step, the CCE filtrate concentration may be approximately 51.3 grams NaOH per liter, with an effective alkali (EA) charge on wood of 13.2% as NaOH. After pre-hydrolysis, the digester 610 may be at roughly 165° C. with a relative pressure of 7 bar (i.e., pressure relative to local atmospheric pressure). At this point, the wood chips or other pulp-containing organic material should be almost air free, with steam present inside the voids within the chips or similar organic material. Almost all chip water is in liquid form.

When pumping neutralization liquor to the digester 610 at a typical temperature of 130° C., the steam inside the chips or other organic material condenses, and liquor is sucked inside the chips or other organic material due to lower pressure created by the condensation. During this process, a certain amount of liquid is added from steam and also lost from de-gassing. For example, with the amounts described above, approximately 11.9 cubic meters of water from steam may be added, and about 1.6 cubic meters of water lost from de-gassing 625. In total, about 224 net cubic meters of liquid, in terms of free liquid (neutralization liquor and steam water), may be added during this part of the cooking process. After pre-hydrolysis and neutralization, the digester 610 may typically contain approximately 203 cubic meters of free liquid, with roughly 109 cubic meters of liquor still bound in the pre-hydrolized chips, which corresponds to 1.31 $m^3$/BDt (cubic meters of liquor per bone dry metric ton of chips) or 3.15 $m^3$/ADt (cubic meters of liquor per air dry metric ton of chips). Thus, a total content of 312 cubic meters of liquid may be present as either free liquid or bound in the chips. At this point, the digester 610 may hold 72 metric tons of wood, 36 metric tons of water absorbed within the wood, and 11 metric tons of dissolved solids of various sorts. The density of the liquid after neutralization in this example would be about 1.13 t/$m^3$ (i.e., tons per cubic meter).

Figure 6B:
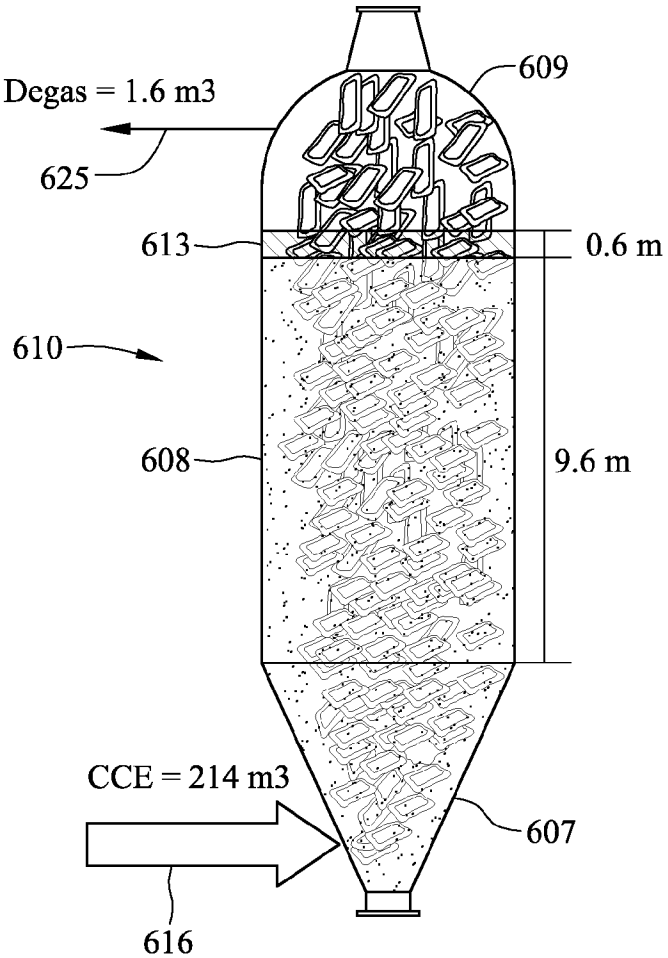
FIGS. 6A and 6B are cross-sectional diagrams of a digester illustrating, among other things, typical liquor and material levels as used in a convention process for the neutralization stage.

As shown now in FIG. 6B, the neutralization liquor added will fill in the voids inside the chips (discounted chip water) and the void space around the chips. Thus, taking the current example, the 214 cubic meters of added neutralization liquor would be distributed as roughly 56.8 cubic meters filling in the void space inside the chips (8.3 cubic meters in the cone 607 of the digester 610 and 48.5 cubic meters in the cylindrical part 608 of the digester 610), and 157.2 cubic meters filling the void space around the chips (22.8 cubic meters in the cone 607 of the digester 610 and 134.4 cubic meters in the cylindrical part 608 of the digester 610). This assumes a volume for the cone 607 of 40 cubic meters and a height of the cylindrical part 608 of 9.6 meters. In this case, the chip amount in the digester cone 607 can be approximated as 9.3 BDt (bone dry metric tons) with a bound liquid volume of 12.3 cubic meters, bound water volume of 4 cubic meters, free liquor around the chips of 22.8 cubic meters, and total volume taken in the cone 607 of 31.1 cubic meters (that is, 22.8+12.3−4.0 cubic meters). A small band of condensate 613 of approximately 0.6-0.7 meters in height collects or forms at the surface of the liquid mixture, where the steam and liquid meet.

A white liquor "pad" or enrichment step in the cooking process can be used to replace part of the CCE alkaline filtrate used in the beginning of the neutralization step in order to reduce or avoid hemicelluloses re-deposition on the wood fibers. Thus, after pre-hydrolysis as first part of the neutralization phase, an amount of white liquor is added preferably in quantity sufficient to fill the voids inside the wood chips or other pulp-containing organic material, followed by an infusion of CCE filtrate. Preferably, for each metric ton of wood chips, approximately 0.35 to 0.55 cubic meters, and more preferably 0.40 to 0.44 cubic meters, of white liquor are added after pre-hydrolysis in order to fill voids inside the wood chips and improve the ultimate alpha content of the pulp being produced. The remainder of the fluid added for neutralization takes the form of CCE alkaline filtrate, as per the conventional process, or optionally may involve using a concentrated CCE alkaline filtrate. Although these steps raise the alkali level in the digester, it has been found by the inventors that hemicelluloses redeposition is inhibited and higher alpha content is achievable while keeping other process attributes, such as viscosity, kappa number and/or effective alkali consumption, within acceptable ranges.

Figure 7C:
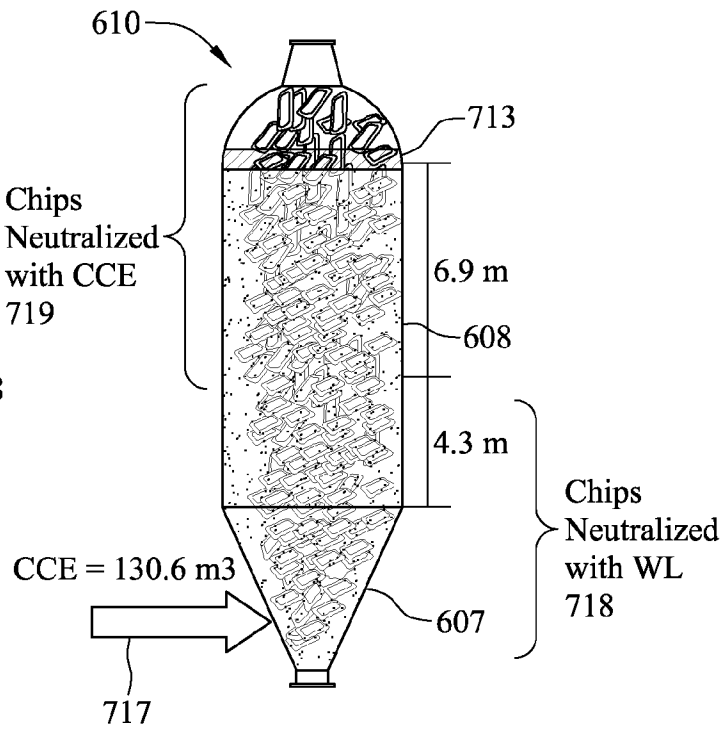
FIGS. 7A, 7B and 7C are cross-sectional diagrams of a digester illustrating, among other things, liquor and material mixtures and levels during the neutralization stage in accordance with one embodiment as disclosed herein.
Figure 7B:
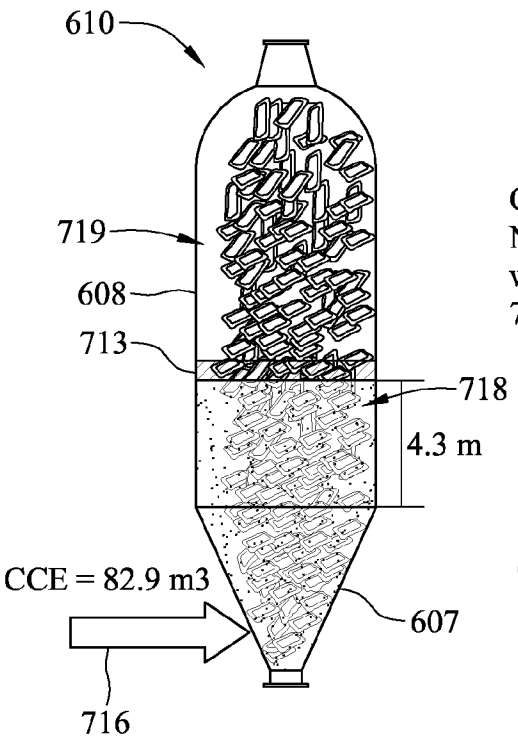
Figure 7A:
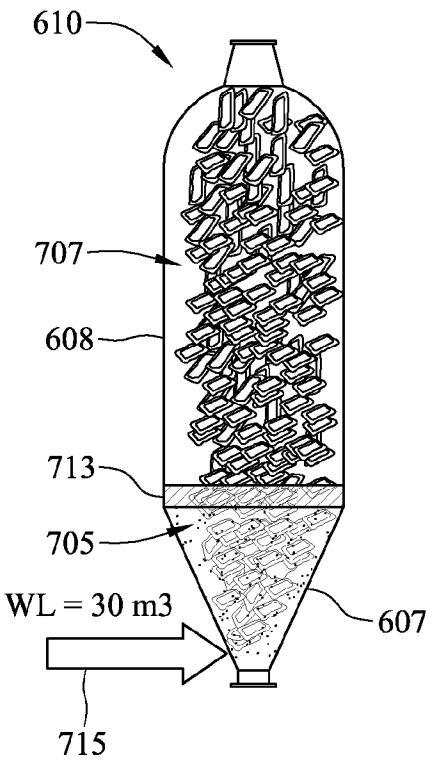

Referring back to the prior example, for instance, a volume of 30 cubic meters of white liquor may be added to the digester 610 containing 72 tons of wood chips after pre-hydrolysis, as illustrated by FIG. 7A. As shown therein, the white liquor pad 715 together with the lower portion of the wood chips or similar organic material approximately fills the cone 607 of the digester 610. Then, a volume of 82.9 cubic meters of CCE filtrate (either enriched or a concentrated CCE alkaline filtrate) may be added to the digester 610 to displace the white liquor pad, with the result that effectively all of the white liquor will be consumed to fill the voids inside the wood chips. This is followed by the introduction of an additional volume of 130.6 cubic meters of CCE filtrate (preferably a concentrated CCE alkaline filtrate) to the digester 610 to complete the neutralization process. FIG. 7B illustrates the contents of the digester 610 after the introduction of the 30 cubic meters of white liquor pad and the 82.9 cubic meters of CCE filtrate 716. As shown, the combination of white liquor pad and initial CCE filtrate cover about 41% percent (roughly 33.9 bone dry metric tons) of the wood mass in the digester 610, as reflected in FIG. 7B by the lower portion 718 of wood chips in the digester 610. The remaining part of the wood chips, as reflected by the upper portion 719 of chips in the digester 610, will be covered with the additional 130.6 cubic meters CCE filtrate 717 that will fill in the voids both in and around the chips, as shown in FIG. 7C. As before, a small band of condensate 713 of approximately 0.6-0.7 meters in height forms at the surface of the liquid mixture.

The white liquor pad added to the digester 610 may have an effective alkali (EA) concentration of 95 to 125 grams NaOH per liter and, more preferably, an effective alkali concentration of between 105 and 115 grams NaOH per liter and, most preferably, approximately 110 grams NaOH per liter. The equivalent alkali charge on the wood in such a case may be approximately 4%. After the addition of the 30 cubic meters of white liquor pad and the 82.9 cubic meters of CCE filtrate 716 but before the remaining CCE filtrate 717, the bound liquor in the cone 607 of the digester 610 is approximately 8.3 cubic meters and the free liquor in the cone is approximately 23 cubic meters. The bound liquor in the cylindrical part 608 of the digester 610 is about 21.7 cubic meters.

The white liquor pad preferably provide at least 10% of the total effective alkali charge applied in the neutralization phase, more preferably provides between 13% and 25% of the total effective alkali charge applied in the neutralization phase, and most preferably provides between 20% and 25% of the total effective alkali charge applied in the neutralization phase. In the above example, the effective alkali charge on wood provided by the white liquor pad is 4%, while for the rest of the neutralization liquor the effective alkali charge on wood is 13.2% from the CCE filtrate, for a total of 17.2% effective alkali charge. Thus, in this example, the white liquor pad provides 23% of the total effective alkali charge on wood.

In one aspect, the use of a white liquor pad as described herein may avoid or reduce pH shock during the neutralization stage since when the CCE filtrate liquor rich in hemicelluloses meet the wood chips or other similar material in the process illustrated in FIGS. 7B and 7C, the chips or other material will be already neutralized by the white liquor. The white liquor pad 715 generally increases the −pH of the wood chips or other similar organic material when it gets absorbed into the chip voids. When the CCE filtrate is added, the remaining white liquor that has not been absorbed is displaced, and as it rises in the digester 610 it continues to neutralize additional wood chips and organic matter before the CCE filtrate can reach those chips or organic matter. Since the CCE filtrate introduction follows the white liquor pad 715, the CCE filtrate liquor enriched with hemicelluloses first meets those chips or organic materials that are already neutralized, which avoids or minimizes pH shock, with the possible exception of the small amount of chips or organic matter towards the very top of the digester 610. The hemicelluloses from the CCE filtrate will stay in the solution rather than being re-absorbed or deposited on the wood chips or organic materials. This in turn increases the purity of the pulp brown stock and ultimately leads to an end product of higher purity.

Figure 9:
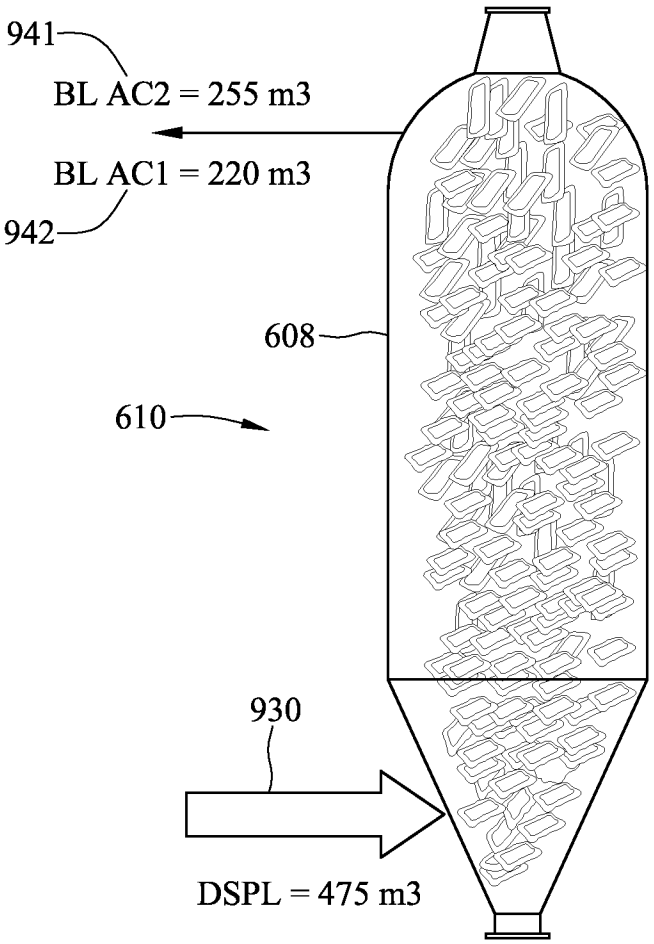
FIGS. 8 and 9 are cross-sectional diagrams of a digester illustrating, among other things, liquor and material mixtures and levels during hot black filling and final liquor displacement in accordance with one embodiment as disclosed herein.
Figure 8:
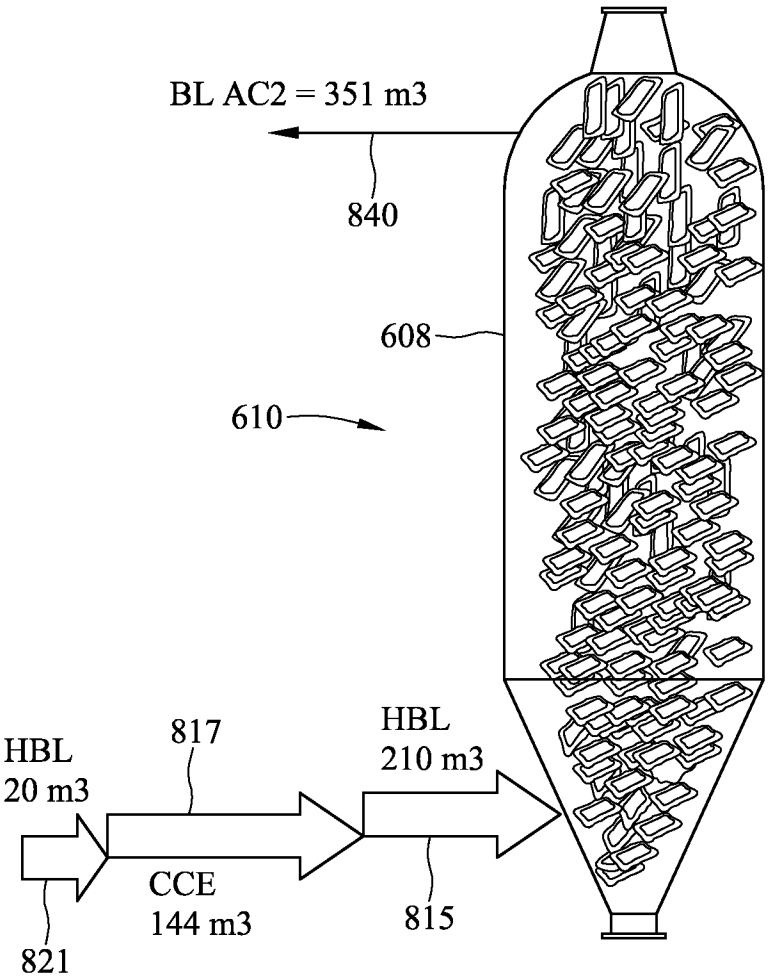

FIGS. 8 and 9 illustrate liquor and material mixtures and levels during the subsequent steps of hot black filling and final liquor displacement, in accordance with one embodiment as disclosed herein. As shown in FIG. 8, which illustrates the introduction of cooking liquors and displacement of existing liquors, a volume of 210 cubic meters of hot black liquor 815 may be added to the digester 610 after completion of the neutralization phase. Then, a volume of 144 cubic meters of CCE filtrate (either enriched CCE filtrate or a concentrated CCE alkaline filtrate) 817 may be added to the digester 610 followed by another volume of 20 cubic meters of hot black liquor 821, thereby displacing the neutralization liquors which have by this point become infiltrated with residues and impurities and hence take the form of a black liquor 840. In this example, 351 cubic meters of black liquor 840 are displaced from the digester 610 and sent to a black liquor accumulator tank ("AC2"), such as accumulator tank 540*b* in FIG. 5.

The alkali charge added with the CCE filtrate in digester 610 in the process shown in FIG. 8 is between 7 and 12% expressed as effective alkali over dry wood and more preferably around 8.9%, expressed in terms of NaOH over dry wood. The total alkali charge needed for the cooking phase is complemented with the alkali added together with the enriched hot black liquor. After the addition of the combination of black liquors 815, 821 and CCE filtrate 716, the total liquid volume inside the digester 610 is approximately 312 cubic meters, the total liquid mass inside the digester 610 is about 353 tons, and the density of the liquor inside the digester 610 is approximately 1.13.

FIG. 9 illustrates the introduction of displacement liquor at the end of the cooking process resulting in the displacement of the spent cooking liquors. As shown in FIG. 9, a volume of 475 cubic meters of displacement liquor 930 may be added to the digester 610 at the end of the cooking phase. The cooking liquors, which have by this point become infiltrated with pulp residues and impurities, may be discharged as a first volume of 220 cubic meters of a relatively strong and hot black liquor 942 which is stored in a first black liquor accumulator tank ("AC1", e.g., tank 540*a* in FIG. 5) for holding a black liquor of this type, and a second volume of 255 cubic meters of relatively weaker black liquor 941 which is stored in a second black liquor accumulator tank ("AC2", e.g., tank 540*b* in FIG. 5) for holding a black liquor of weaker type. Some amount of cooking liquor remains bound to the cooked wood chips or other pulp-bearing organic materials. The process yields approximately 31.1 bone dry tons of cooked pulp, with roughly 41.1 tons of solids having been dissolved in the cooking and related processes.

Figure 10:
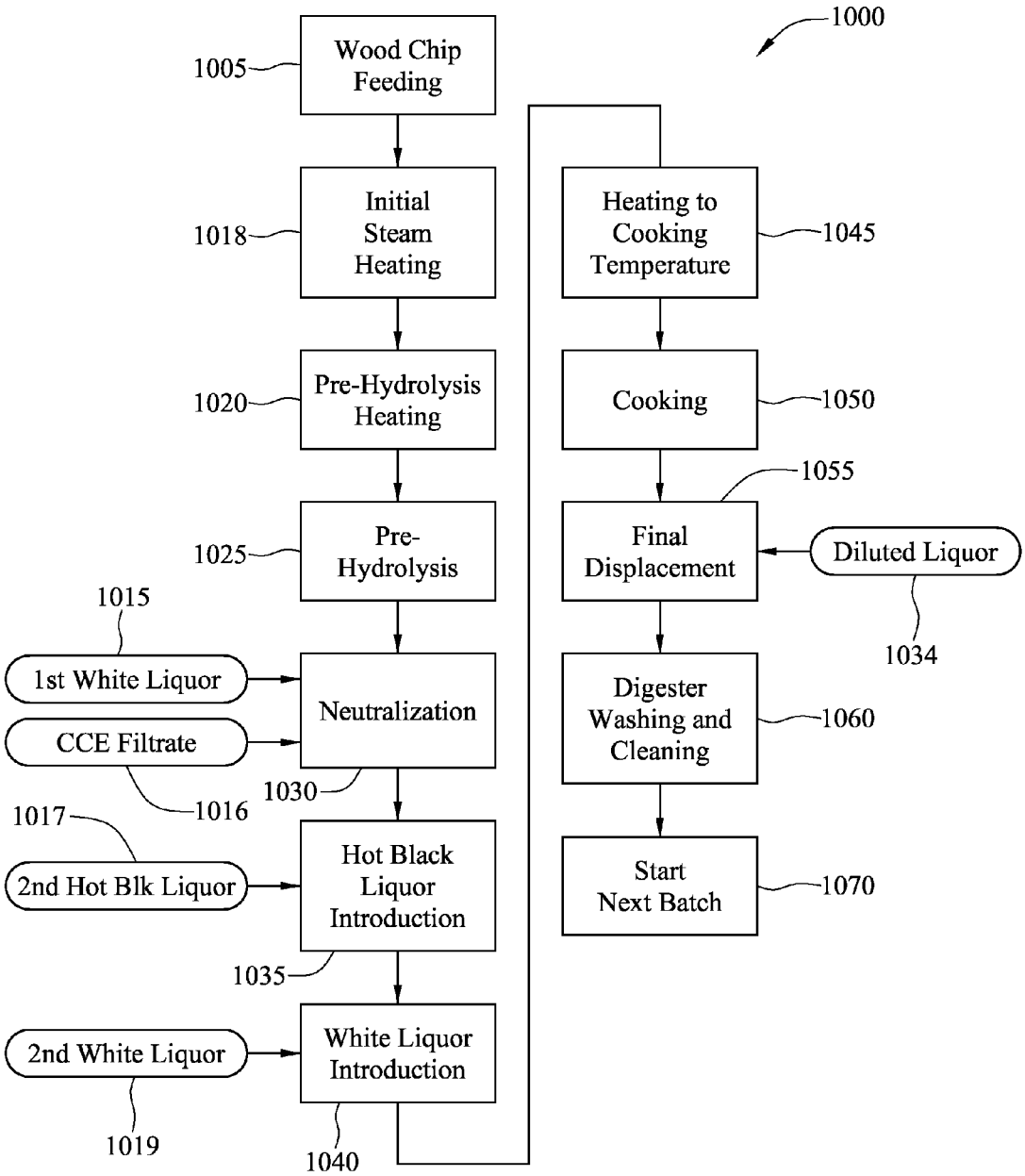
FIG. 10 is a process flow diagram of a preferred cooking process as may be used in a cold caustic extraction pulp manufacturing process, in accordance with one or more embodiments as disclosed herein.

FIG. 10 is a process flow diagram of a cooking process 1000 as may be used in a cold caustic extraction pulp manufacturing process, in accordance with one or more embodiments as disclosed herein. The process 1000 in FIG. 10 begins with a wood chip feeding step 1005 in which wood chips or other pulp-containing organic materials along with steam are fed into a digester capable of withstanding high pressure. As previously noted, the particular choice of wood type or other plant or organic materials may depend upon the desired end products. The steam is introduced to improve the packing of the chips inside the digester. The digester may then be heated in one or more steps; in this example, the digester is heated to a pre-determined temperature (for example, be between 110 to 130° C. and, more specifically, may be approximately 120° C.) by steam or otherwise in an initial heating step 1018, followed by heating to a pre-hydrolysis temperature (to around 165° C. for example) in a subsequent step 1020, although these two steps may, in some embodiments, potentially be combined. The heating time may depend to some degree upon the particulars of the equipment, the volume of the digester, the volume of wood chips, and the nature of the organic materials being heated.

Once the pre-hydrolysis temperature is attained, the digester is held at that temperature for a suitable period of time, e.g., 35 to 45 minutes, or any other time sufficient to complete a pre-hydrolysis stage 1025. Next, a neutralization step 1030 is carried out. In a preferred embodiment, a neutralization solution comprising a white liquor 1015 is first added to the digester, followed by introduction of a CCE filtrate liquor 1016. The white liquor 1015 may take the form of, e.g., a mixture of sodium hydroxide and sodium sulfide, with an effective alkali content in accordance with any of the embodiments described elsewhere herein. For instance the white liquor 1015 may have between 80 to 150 grams per liter effective alkali as sodium hydroxide (NaOH), and preferably between 100 to 110 grams per liter of effective alkali as sodium hydroxide. The sulfidity of the white liquor 1015 is preferably between 20 and 30% but may, in some embodiments, vary. The CCE filtrate 1016 may comprise recycled CCE alkaline filtrate that is obtained from a downstream CCE washing process and optionally concentrated by evaporation or other means. The concentration of effective NaOH in the CCE filtrate 1016 may be between, e.g., 50 to 75 grams per liter, although it may vary according to the particular process.

Preferably, the white liquor 1015 is introduced first as a "pad" in accordance with the process described for FIGS. 7A-7C, followed by the CCE filtrate liquor 1016. Then, in step 1035, a second portion of hot black liquor 1017 is introduced into the digester, as described in connection with FIG. 8.

In a next step 1040, a second white liquor 1019 is added to the digester for cooking purposes. As an alternative, the white liquor 1019 can be replaced by recycled CCE alkaline filtrate that is obtained from a downstream CCE washing process and optionally concentrated by evaporation or other means. During this phase as indicated by step 1045, the contents of the digester are heated, by steam or other means, to an appropriate cooking temperature; this temperature is maintained in a cooking step 1050 for a period suitable to achieve delignification of the wood pulp in the digester. The cooking temperature may be in the range between 140 and 180° C., and is preferably in the range between 150 to 160° C., although could be any suitable temperature. The heating can be over a period of 10 to 30 minutes or other suitable period. The digester is held at the cooking temperature for a suitable period for the cooking process, such as between 15 to 120 minutes. The temperature range and the cooking time are generally chosen for target H factor, as previously described.

After cooking, as indicated by step 1055, a diluted black liquor 1034 in general from the brown stock washing step is introduced to the digester and the pulp contents are discharged for downstream processing. Then, the digester is discharged and may be washed and cleaned, as indicated by step 1060, and the next batch of wood chips may be processed in the same fashion, as indicated by step 1070.

EXAMPLES

The processes of embodiments of the present invention are demonstrated in the following examples. Analytical results described in the examples are obtained using the general process illustrated in FIG. 11, which lists a series of steps performed in general accordance with the process flow 1000 of FIG. 10, and are described with reference to a bench scale digester of approximately 20 liters volume to simulate an industrial process. Differences between the procedure illustrated in FIG. 11 and the specific examples are explained in more detail below.

Figure 11:
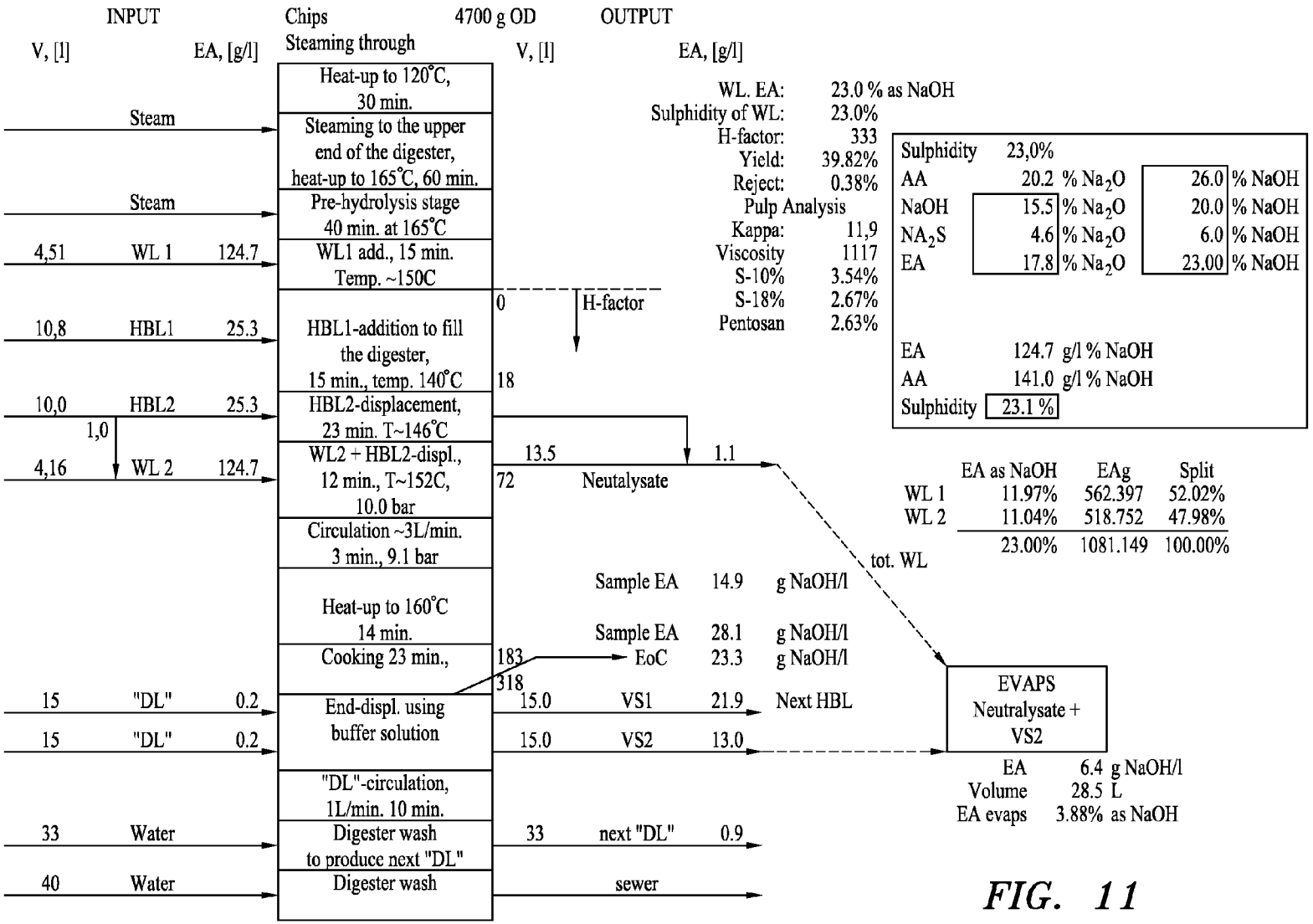
FIG. 11 is a diagram showing a datasheet used to calculate and register the liquor volumes "in" and "out" in the bench (lab) scale digester and process conditions in general accordance with the process flow of FIG. 10.

As indicated in FIG. 11, the process normally begins with digester pre-steaming for 30 minutes to attain initial temperature and humidity in the digester, along with the addition of wood chips (in this case eucalyptus) to the digester; although in the case of a laboratory no steam packing may be needed. The digester is then heated further by providing steam to the digester, for a period of approximately 60 minutes to bring the temperature to 165° C. A pre-hydrolysis step is then carried out for, e.g., approximately 40 minutes at a temperature of 165° C. Then, in some examples, a CCE allkaline filtrate or a first white liquor pad is added as part of a neutralization process. This process takes approximately 15 minutes and is carried out at a temperature of roughly 150° C. Next, a first hot black liquor is added to fill the remainder of the digester. The introduction of the first hot black liquor takes approximately 15 minutes and is carried out a temperature of 140° C. Next, a second hot black liquor is added to the digester during a displacement step, which is carried out for 23 minutes at a temperature of approximately 146° C. These two hot black liquor steps collectively represent a hot liquor fill as would be carried out in an industrial operation. Next, a white liquor or CCE alkaline filtrate is added to finish the displacement process, starting the cooking phase. If necessary, some hot black liquor may also be fed to the digester. This mixture of white liquor (or CCE alkaline filtrate) and hot black liquor may be carried out for, e.g., 12 minutes at a temperature of approximately 152° C. and a pressure of 10.0 bar. For the cooking step, the liquor is circulated through digester at a rate of approximately 3 liters per minute during 3 minutes at a slightly reduced pressure of 9.1 bar. The contents of the digester are then heated back up to, e.g., roughly 160° C. over a period of 14 minutes, and then maintained at that temperature during a suitable cooking period for about, e.g., 23 minutes. Next, a diluted liquor is introduced as a displacement liquor and the contents of the digester are discharged for downstream processing. The diluted liquor continues to be introduced at a rate of one liter per minute and is circulated in the digester for a sufficient period. The digester is then discharged, and may be washed and cleaned to ready for a new batch.

FIGS. 13A and 13B are tables summarizing various process conditions and results according to Examples 2-9 described below. In particular, FIG. 13A shows the process conditions and parameters for the various different examples, and FIG. 13B shows the corresponding results in tabular form.

Example 1

Kraft Process Using a Combination of White Liquor and Hot Black Liquors in the Neutralization and Cooking Step According to a first example, a 20-liter bench scale digester is pre-heated with steam to 120° C. over a period of 30 minutes. 4700 grams of oven dried pulp-containing organic material such as eucalyptus or other wood chip is added to the digester. The lab sequence operations follows the FIG. 11. The digester is heated to 165° C. over a period of 60 minutes and held at 165° C. for a further 40 minutes to complete the pre-hydrolysis stage. 4.51 liters of a first white liquor ("WL1") with an effective alkali of 124.7 g NaOH per liter is added to the digester over fifteen minutes at a temperature of 150° C. The H factor calculation starts at this point. Then, 10.8 liters of a first hot black liquor ("HBL1") with an effective alkali of 25.3 g NaOH per liter is added over 15 minutes at a temperature of 140° C. to complete the neutralization step. 10.0 liters of a second hot black liquor ("HBL2") with an effective alkali of 25.3 g NaOH per liter is then added to the digester to displace the spent HLB1 and WL1 over a period of 23 minutes at a temperature of 146° C., followed by addition of the cooking liquor consisting of a mixture of 1 liter of HBL2 and 4.16 liter of a second white liquor ("WL2") with an effective alkali concentration of 124.7 g NaOH per liter added over a period of 12 minutes at 10 bar and 152° C. One meaningful process parameter during this series of operations is the Total Effective Alkali charge, which is generally expressed in terms of alkali percentage on the wood chips weight (dry basis) that is calculated considering the entire volume of all added liquors and their respective concentrations. For this example, the total equivalent effective alkali charge on the wood is 12% EA as NaOH for the neutralization phase, and 11% EA as NaOH for the cooking phase, Samples of the displaced WL1 and HBL1 after the neutralization step (the "Neutralysate") are collected to measure and follow the pH behavior, typically from the beginning of the displacement operation to the end of that operation. The displaced liquor is collected for later recovery.

The cooking liquor, comprising of HBL2 and WL2, is circulated at a rate of 3 liter per minute for 3 minutes under a pressure of 9.1 bar. The digester is then heated to 160° C. over a period of 14 minutes, and held at 160° C. for another 23 minutes. An aliquot of the reaction mixture is taken to measure the concentration of NaOH at the end of the reaction ("EoC"). The EoC is approximately 23.3 g NaOH per liter.

The digester is then cooled, and the reaction mixture is washed twice with a diluted caustic solution. Each wash uses 15-liter of an aqueous solution containing approximately 0.2 g NaOH per liter of a diluted liquor solution ("DL"). The spent liquor after the first wash contains approximately 21.9 g NaOH per liter, and may be used to prepare a next batch of hot black liquor. The spent liquor after the second wash contains approximately 13.0 g NaOH per liter and is combined with the Neutralysate. The combined liquor has an EA of 6.4 g NaOH per liter (equivalent to 3.88% NaOH). In the mill this mixture may be evaporated to form a more concentrated caustic solution for the recovery boiler burning.

The lab bench digester is cleaned by first circulating DL (diluted liquor) through the digester at 1 liter per minute for 10 minutes, and then washed twice first with 33 liter of pure water and then with 45 liter of pure water. The spent washing liquor from the first wash contains approximately 0.9 g NaOH per liter and may be used to prepare the next batch of DL.

The resulting brown stock shows a Kappa Number of 11.9, a viscosity of 1117 ml/g, a S10 solubility of 3.54% and a S18 solubility of 2.7%. The reaction has a 39.8% yield. When screened, the mixture has a 0.4% rejection rate, resulting in a screening yield of 39.4%. The H factor for the reaction is 333.

Figure 12:
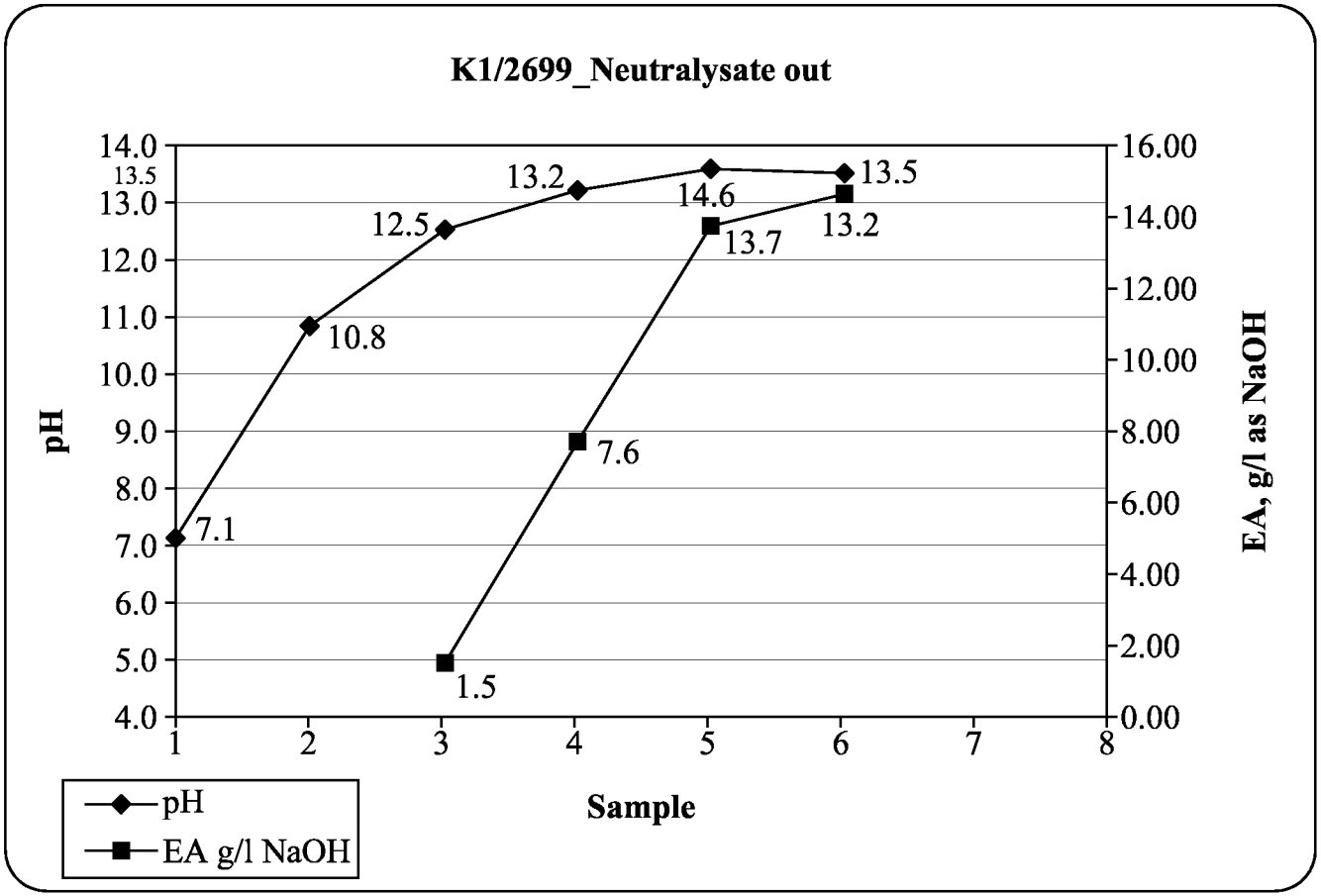
FIG. 12 is a graph charting the pH and effective alkali concentrations of the neutralisate out of various samples in connection with the process of FIG. 11.

FIG. 12 is a graph charting the pH and effective alkali concentrations of the Neutralysate out of various samples, indicating the leveling off of alkali content signaling the general completion of the cooking stage.

Example 2

Kraft Process Using White Liquor in the Neutralization and Cooking Step

According to a second example, the same pulping process as described in Example 1 is repeated, using white liquor in both neutralization and cooking phases. The Neutralysate has a pH of 10.2, and the final cooking liquor has an EoC of 26.7 g NaOH per liter. The P factor for the pre-hydrolysis is 310 and the H factor for the cooking reaction is 394. For this example the total equivalent effective alkali charge on the wood are respectively: 12% EA as NaOH for the neutralization phase and 11% EA as NaOH for the cooking phase.

The resulting brown stock shows a Kappa Number of 10.3, a viscosity of 988 ml/g, an S10 solubility of 3.6% and an S18 solubility of 2.7%. The reaction has a 39.3% yield. When screened, the mixture has a 0.13% rejection rate, resulting in a screening yield of 39.1%.

Example 3

Kraft Process Using CCE 54 in the Neutralization and White Liquor in the Cooking Step Respectively According to a third example, the same pulping process as described in Example 1 is repeated, except that white liquor for the neutralization is replaced with a filtrate from the CCE step having an EA of 54 g NaOH per liter ("CCE54"). The Neutralysate has a pH of 8.6, and the cooking mixture has an EoC of 23.5 g NaOH per liter. The P factor for the pre-hydrolysis is 300, and the H factor for the cooking reaction is 364. For this example the total equivalent effective alkali charge on the wood are respectively: 12% EA as NaOH for the neutralization phase and 11% EA as NaOH for the cooking phase.

The resulting brown stock shows a Kappa Number of 11.0, a viscosity of 1059 ml/g, an S10 solubility of 4.0% and an S18 solubility of 3.1%. The reaction has a 40.3% yield. When screened, the mixture has a 0.16% rejection rate, resulting in a screening yield of 40.2%.

Example 4

Kraft Processing Using CCE54 in the Neutralization and Cooking Step

According to a fourth example, the same pulping process as described in Example 1 is repeated, except that CCE54 replaces the white liquor in both the neutralization and cooking step. The Neutralysate has a pH of 11.0, and the cooking mixture has an EoC of 18.5 g NaOH per liter. The P factor for the pre-hydrolysis is 297 and the H factor for the cooking reaction is 419. For this example the total equivalent effective alkali charge on the wood are respectively: 12% EA as NaOH for the Neutralization phase and 11% EA as NaOH for the Cooking phase.

The resulting brown stock shows a Kappa Number of 10.8, a viscosity of 1118 ml/g, an S10 solubility of 4.5% and an S18 solubility of 3.6%. The reaction has a 40.4% yield. When screened, the mixture has a 0.09% rejection rate, resulting in a screening yield of 40.3%.

Example 5

Kraft Processing Using "Weak" White Liquor in the Neutralization and Cooking Step According to a fifth example, the same pulping process as described in Example 1 is repeated, except that a white liquor having an EA of 54 g NaOH per liter ("WL54") is used in both the neutralization and cooking step. The Neutralysate has a pH of 11.3, and the cooking mixture has an EoC of 18.8 g NaOH per liter. The P factor for the pre-hydrolysis is 300, and the H factor for the cooking reaction is 429. For this example the total equivalent effective alkali charge on the wood are respectively: 12% EA as NaOH for the neutralization phase and 11% EA as NaOH for the cooking phase.

The resulting brown stock shows a Kappa Number of 11.2, a viscosity of 1158 ml/g, an S10 solubility of 3.7% and an S18 solubility of 3.1%. The reaction has a 40.2% yield. When screened, the mixture has a 0.12% rejection rate, resulting in a screening yield of 40.0%.

Comparison of the S18 solubility in Examples 2 and 5 suggests that higher alkali concentration may help suppress hemicellulose redeposition in the cooking step. Comparison of the results in Examples 3, 4 and 5 suggest that the use of CCE filtrate has a negative impact on the hemicellulose content in the final product. To further reduce hemicellulose content while maximizing the utilization of CCE filtrates, the following experiments are performed.

Example 6

Kraft Process Using CCE60 in the Neutralization and Cooking Step

According to a sixth example, the same pulping process as described in Example 1 is repeated, except that a CCE filtrate having an EA of 60 g NaOH per liter ("CCE60") replaces white liquor in both the neutralization and cooking step. The cooking temperature due to the higher alkali charge in the cooking phase is lowered from 160 to 155° C., but the cooking time is correspondingly increased. The Neutralysate has a pH of 11.2, and the cooking mixture has an EoC of 24.5 g NaOH per liter. The P factor for the pre-hydrolysis is 272, and the H factor for the cooking reaction is 389. For this example the total equivalent effective alkali charge on the wood are respectively: 12% EA as NaOH for the neutralization phase and 12.5% EA as NaOH for the cooking phase.

The resulting brown stock shows a Kappa Number of 11.4, a viscosity of 1155 ml/g, an S10 solubility of 4.6% and an S18 solubility of 3.6%. The reaction has a 40.7% yield. When screened, the mixture has a 0.07% rejection rate, resulting in a screening yield of 40.6%. While CCE60 allows the cooking temperature be reduced by 5° C., the cooking time and alkali charge for cooking are lengthened and the hemicellulose content in the brown stock is not reduced as compared to when CCE54 is used.

Example 7

Kraft Process Using CCE60 in the Neutralization and a Combination of CCE60 and HBL40 in the Cooking Step Respectively According to a seventh example, the same pulping process as described in Example 6 is repeated, except that a more highly concentrated hot black liquor having an EA of 40.0 g per liter ("HBL40") is used in the cooking step. In this example the total alkali charge in the cooking step increased to 13.0% because of the use of more highly concentrated black liquor (HBL40) as a portion of the cooking liquor.

In addition, while the cooking temperature is also at 155° C. as in Example 6, the cooking time is shorter and comparable to the cooking time in Examples 2-5 where the cooking is performed at 160° C. As consequence the H factor for the cooking reaction is lower at 377. The Neutralysate has an EA of 3.1 g NaOH per liter, and the cooking mixture has an EoC of 29.5 g NaOH per liter. The P factor for the pre-hydrolysis is 301. For this example the total equivalent effective alkali charge on the wood are respectively: 12% EA as NaOH for the neutralization phase and 13% EA as NaOH for the cooking phase The resulting brown stock shows a Kappa Number of 10.3, a viscosity of 1107 ml/g, an S10 solubility of 4.1% and an S18 solubility of 3.1%. The reaction has a 40.1% yield. When screened, the mixture has a 0.09% rejection rate, resulting in a screening yield of 40.0%. Compared to Example 6, a lower hemicellulose content as evidenced by S18 solubility is observed. Thus, the use of a higher alkali concentration and a combination of alkaline fluids in the cooking step appears to result in reduced hemicellulose content.

Example 8

Kraft Process Using a CCE70 in the Neutralization and Cooking Step

According to an eighth example, the same pulping process as described in Example 7 is repeated, except that a CCE filtrate having an EA of 70 g NaOH per liter ("CCE70") is used in the neutralization step and a combination of CCE70 and HBL40 is used in the cooking step. In addition the effective alkali charge in the cooking phase is 15%.

The Neutralysate has a pH of 11.6, and the cooking mixture has an EoC of 36.1 g NaOH per liter. The P factor for the pre-hydrolysis is 304 and the H factor for the cooking reaction is 301.

The resulting brown stock shows a Kappa Number of 11.0, a viscosity of 1119 ml/g, an S10 solubility of 4.0% and an S18 solubility of 2.9%. The reaction has a 40.0% yield. When screened, the mixture has a 0.13% rejection rate, resulting in a screening yield of 39.9%. Compared to Examples 6 and 7, a lower hemicellulose content as evidenced by S18 solubility is also observed. This reinforces that the use of a higher alkali concentration and a combination of alkaline fluids in the cooking step appears to result in reduced hemicellulose content.

Example 9

Kraft Process Using White Liquor Pad

According to a ninth example, the same pulping process as described in Example 7 is repeated, except that for neutralization step the CCE60 is replaced with first a volume of white liquor with having an EA about 125 g NaOH per liter in the form of a white liquor pad as previously described, being followed by the CCE filtrate (CCE60). The effective alkali charge in the neutralization step is increased from 12% to 16% (4% due to the while liquor pad). As a consequence the effective alkali charge in the cooking phase is reduced from 13% to 11%.

The Neutralysate has an EA of 4.5 g NaOH per liter, and the cooking mixture has an EoC of 31.7 g NaOH per liter. The P factor for the pre-hydrolysis is 303 and the H factor for the cooking reaction is 367.

The resulting brown stock shows a Kappa Number of 9.7, a viscosity of 1103 ml/g, an S10 solubility of 4.0% and an S18 solubility of 3.0%. The reaction has a 39.9% yield. When screened, the mixture has a 0.03% rejection rate, resulting in a screening yield of 39.9%. A lower hemicellulose content as evidenced by S18 solubility is also observed. The delignification degree measured as Kappa Number (KN) is lower for the same level of viscosity (about 1100 ml/g) which indicates a better process selectivity, as reflected by the ratio between viscosity and Kappa Number.

also may result in reduced cooking temperature with no adverse effect on cooking time or pulp quality. Further experiments on industrial scales are performed to confirm the benefits of the invention.

Example 10

Industrial Scale Kraft Process with and without White Liquor Pad

Figure 6A:
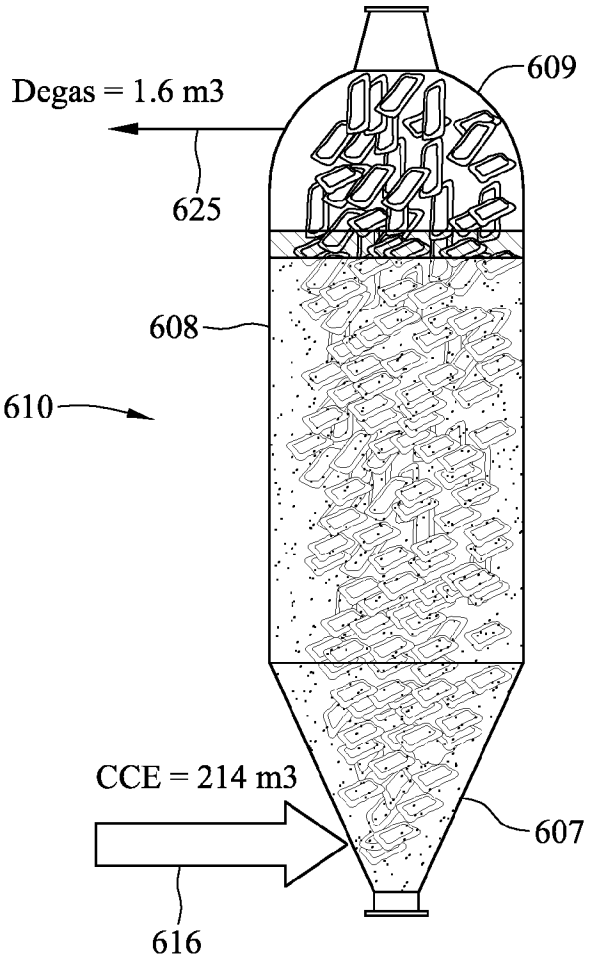

A kraft cooking process is performed as generally described in relation to FIGS. 4 and 5. A conventional neutralization step is performed as illustrated in FIGS. 6A and 6B, and an improved process using a white liquor pad is performed as illustrated in FIGS. 7A-7C. In the improved process, 40 cubic meters of white liquor having an effective alkali (EA) level of 110 g NaOH per liter ("WL110") is pumped first into the digester at a rate of 180 $m^3$/hour at the beginning of the neutralization step (a filling period of 13 minutes), followed by 72.9 cubic meters of CCE filtrate with an effective alkali (EA) level of approximately 60 grams NaOH per liter. The concentration of the CCE filtrate from the CCE washing process (e.g., process 424 in FIG. 4) was in this case adjusted from 53-55 grams NaOH per liter to 60 grams NaOH per liter by adding concentrated white liquor, a process that may be referred to as enrichment with white liquor. After the neutralization step, and following the industrial digester operation sequence described in reference to FIG. 10, first a volume of hot black liquor with an effective alkali (EA) level of approximately 45 grams NaOH per liter ("HBL45") and then a volume of CCE alkaline filtrate with an effective alkali (EA) level of 60 grams NaOH per liter are added to displace the spent neutralization liquor. The wood chips are then cooked at a temperature of approximately 150-153° C. to achieve the target H factor. Small adjustments of cooking conditions were made to achieve a target viscosity.

The various experimental conditions and resulting pulp quality are summarized below in Table 1 below.

TABLE 1

| | Cooking Conditions | | | | | Pulp Quality | | |
|---|---|---|---|---|---|---|---|---|
| Entry | WL Pad Used? | CCE filtrate conc. (g NaOH/l) | HBL conc. (g NaOH/l) | H Factor | Cooking Temp. (° C.) | Kappa No. | Viscosity | S18 After Cooking |
| 1 | No | 62.6 | 45 | 200 | 153 | 10.7 | 1013 | 3.6 |
| 2 | No | 63.4 | 45 | 200 | 151 | 10.2 | 1028 | 3.7 |
| 3 | Yes | 67.7 | 45 | 200 | 151 | 8.5 | 921 | 2.9 |
| 4 | Yes | 63.5 | 45 | 175 | 151 | 8.5 | 942 | 3.1 |
| 5 | Yes | 62.2 | 45 | 150 | 151 | 8.8 | 1025 | 3.1 |
| 6 | Yes | 63.7 | 45 | 125 | 151 | 11.2 | 1074 | 3.2 |
| 7 | Yes | 63.4 | 45 | 150 | 152 | 9.9 | 953 | 3.0 |
| 8 | Yes | 61.0 | 45 | 140 | 152 | 10.5 | 1031 | 2.7 |
| 9 | Yes | 61.8 | 45 | 125 | 152 | 10.4 | 1033 | 3.0 |
| 10 | Yes | 58.6 | 45 | 125 | 150 | 10.6 | 1031 | 3.0 |

Comparison of the results in Examples 2 to 9 (as summarized in the tables shown in FIGS. 13A-13B) suggest that hemicelluloses redeposition may be reduced through the use of a white liquor pad in the neutralization step and the use of a combination of CCE filtrate and higher concentrated black liquor in the cooking step. In addition, the use of higher concentrated hot black liquor results in higher effective alkali charge, which is desirable as this often, leads to a better delignification selectivity (lower Kappa number for same viscosity level). The use of a white liquor pad and a combination of CCE filtrate and more concentrated hot black liquor As illustrate by the results above, the use of a white liquor pad before the addition of CCE filtrate in the neutralization step results in reduced hemicellulose redeposition on the fibers, as evidenced by the lower S18 solubility in the resulting pulp (by comparison of entries 1-2 with entries 3-10 in Table 1). Without the white liquor pad, the S18 solubility remains at 3.6% or above. The use of a white liquor pad, optionally with CCE filtrate and black liquor, as well as white liquor enrichment during neutralization and cooking, enables achieving simultaneously an S18 solubility of approximately 3.0% or less with a Kappa number of roughly between 10 and 11 (although more broadly the kappa number value may range between about 8 and 12 depending upon process parameters), and in general provides a higher quality pulp product as compared to conventional techniques.

Figure 14:
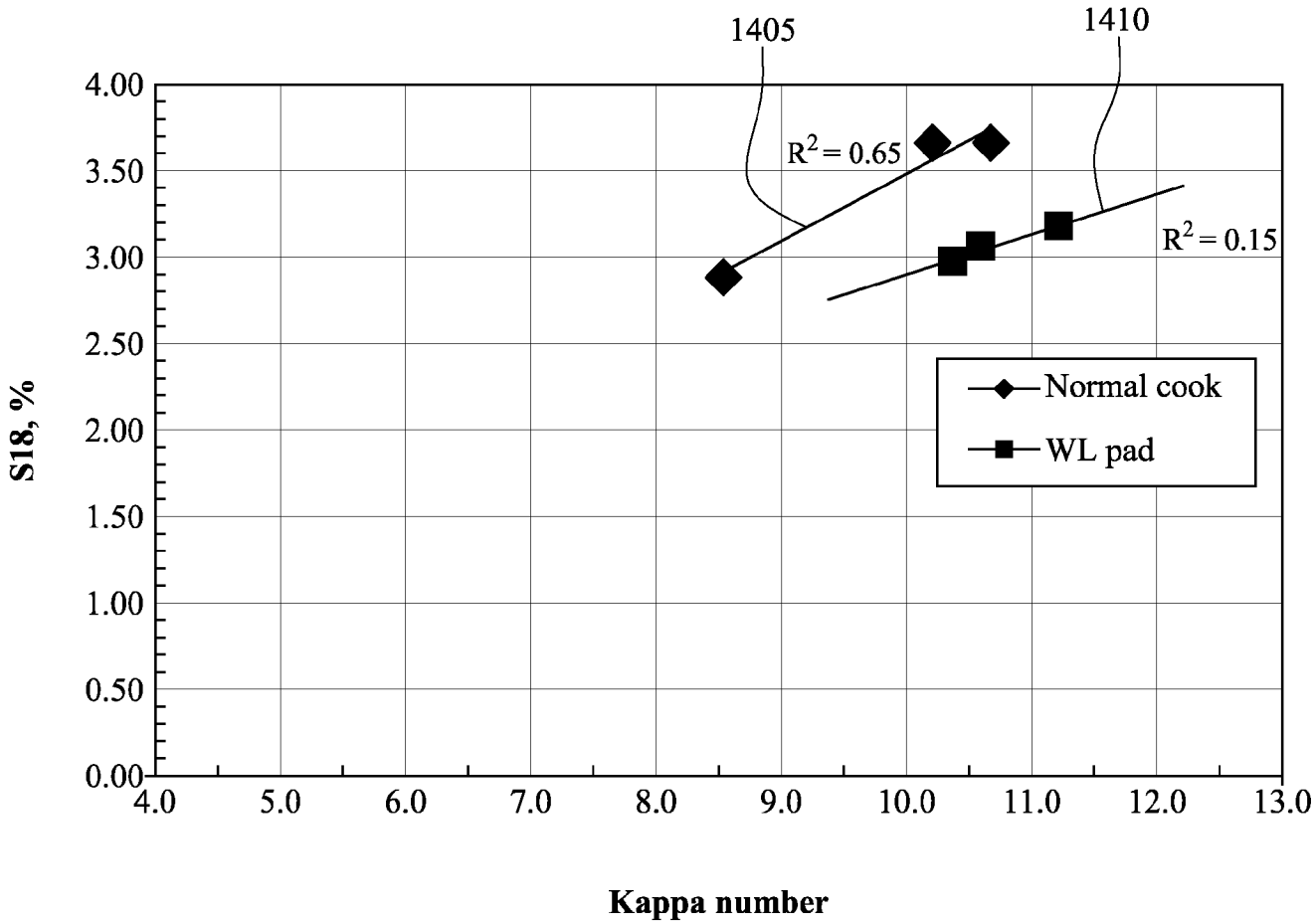
FIG. 14 is a graph of S18 versus kappa number for a process according to one embodiment as disclosed herein.

FIG. 14 is a graph of S18 versus Kappa number for a process according to one embodiment as disclosed herein, based on quantities used for an industrial run (similar to the quantities described with respect to the cooking processes explained in connection with FIGS. 6-9). As shown in FIG. 14, the S18 value (in percent) and Kappa number for a conventional cooking process is illustrated by the line 1405, while the S18 and kappa number values for a process using the white liquor pad as detailed herein is shown by line 1410. The values when using the white liquor pad are superior. In particular, the process based on embodiments disclosed herein may yield an S18 value in the range of 3.0, indicating a low residual hemicellulose content.

The kappa number values and solubility values provided above represent post-cooking characteristics of the brown stock, prior to downstream cold caustic extraction and bleaching. After conventional cold caustic extraction is performed, the kappa number would generally be reduced to approximately 7 to 9, and the S18 solubility may be below 1.7% and may reach the range of 1.5%. These values represent a highly purified pulp with an alpha cellulose content of approximately 97.5% before bleaching, and having favorable viscosity characteristics, achieved in a manner that is efficient and lower cost than conventional methods for performing high quality pulp processing.

In addition, use of a white liquor pad as described herein may avoid or reduce pH shock during the neutralization stage since when the CCE filtrate liquor rich in hemicelluloses meet the chips, they will be already neutralized by the white liquor. The white liquor pad generally increases the –pH of the wood chips or other similar organic material when it gets absorbed into the chip voids. The white liquor pad elevates the pH of the chips or other similar material after the prehydrolysis stage but before the CCE filtrate liquor enriched with hemicelluloses first meet the chips. By this effect, pH shock is avoided or minimized, and the hemicelluloses from the recycled CCE filtrate will stay in the solution rather than being re-absorbed or deposited on the pulp. This in turn increases the purity of the pulp brown stock and ultimately leads to an end product of higher purity.

While preferred embodiments of the invention have been described herein, many variations are possible which remain within the concept and scope of the invention. Such variations would become clear to one of ordinary skill in the art after inspection of the specification and the drawings. The invention therefore is not to be restricted except within the spirit and scope of any appended claims.

What is claimed is:

1. A method for processing pulp-containing organic material that has undergone pre-hydrolysis in a reaction vessel, as part of a kraft process for producing dissolving pulp, comprising:

adding a first quantity of white liquor to the reaction vessel as a first neutralization fluid to only partially fill available space within the reaction vessel with the white liquor, while maintaining the vessel at a temperature of between 120° C. and 180° C., the white liquor constituting a first alkaline solution;

after adding the first quantity of white liquor, adding a second alkaline solution other than white liquor or only partially containing white liquor, and containing a filtrate that has not been treated to decompose or remove hemicelluloses, to the reaction vessel to constitute, along with the first quantity of white liquor, a complete neutralization fluid present in the reaction vessel;

displacing the neutralization fluid with one or more cooking fluids suitable for carrying out kraft cooking;

cooking the pulp-containing organic material in the reaction vessel; and discharging the cooked pulp from the reaction vessel.

2. The method of claim 1, wherein the white liquor has an effective alkali level of between 100 and 130 grams NaOH per liter.

3. The method of claim 1, wherein the second alkaline solution comprises a cold caustic extraction alkaline filtrate that has not been treated to decompose or remove hemicelluloses.

4. The method of claim 3, wherein the cold caustic extraction alkaline filtrate has an effective alkali level of between 50 and 75 grams NaOH per liter.

5. The method of claim 4, wherein the cold caustic extraction alkaline filtrate has an effective alkali level of between 60 and 68 grams NaOH per liter.

6. The method of claim 4, wherein the cold caustic extraction alkaline filtrate is enriched with white liquor to increase its effective alkali concentration.

7. The method of claim 1, wherein the cooking fluid comprises a cold caustic extraction alkaline filtrate as a substitute for white liquor, the cold caustic extraction alkaline filtrate not having been first treated to decompose or remove hemicelluloses.

8. The method of claim 7, wherein the cold caustic extraction alkaline filtrate has an effective alkali level of between 50 and 75 grams NaOH per liter.

9. The method of claim 7, wherein the cold caustic extraction alkaline filtrate has an effective alkali level of between 60 and 68 grams NaOH per liter.

10. The method of claim 7, wherein the cold caustic extraction alkaline filtrate is enriched with white liquor.

11. The method of claim 1, wherein a hot black liquor is used as one of the cooking fluids in the cooking step in conjunction with cold caustic extraction alkaline filtrate that has not been first treated to decompose or remove hemicelluloses.

12. The method of claim 11, wherein the hot black liquor has an effective alkali level of between 38 and 50 grams NaOH per liter.

13. The method of claim 11, wherein the hot black liquor has an effective alkali level of between 40 and 45 grams NaOH per liter.

14. The method of claim 13, wherein the hot black liquor enriched with white liquor to increase its effective alkali concentration.

15. The method of claim 1, wherein after the cooked pulp is subject to a cold caustic extraction (CCE) stage, a purified pulp is yielded having an alpha content exceeding 98%.

16. The method of claim 15, wherein the purified pulp has a kappa number of between 7 and 9.

17. The method of claim 1, wherein the first quantity of white liquor provides at least 10% of a total effective alkali charge applied in the neutralization phase.

18. The method of claim 1, wherein the first quantity of white liquor provides between 13% and 25% of a total effective alkali charge applied in the neutralization phase.

19. The method of claim 1, wherein the pulp-containing organic material comprises Eucalyptus.

20. A method for pulp processing used in a kraft process for producing dissolving pulp, comprising:

adding pulp-containing organic materials to a digester;

performing pre-hydrolysis on the pulp-containing organic material in the digester;

adding a first quantity of white liquor to a base of the digester as a neutralization fluid to partially fill remaining space in the digester, in order to elevate a pH level within the digester and reduce pH shock of additional fluids for neutralization;

after adding the first quantity of white liquor, adding a solution including a first quantity of cold caustic extraction alkaline filtrate to fill the digester from the base in order to carry out neutralization of the contents of the digester using the combination of the first quantity of white liquor and the added solution, the cold caustic extraction alkaline filtrate not having been first treated to decompose or remove hemicelluloses;

displacing the neutralization fluid with one or more cooking fluids comprising at least a hot black liquor enriched with an additional quantity of white liquor, followed by a second quantity of cold caustic extraction alkaline filtrate;

cooking the pulp-containing organic material in the digester; and discharging the cooked pulp from the digester.

21. The method of claim 20, wherein the white liquor has an effective alkali level of between 100 and 130 grams NaOH per liter.

22. The method of claim 21, wherein the first quantity of white liquor provides at least 10% of the total effective alkali charge applied during neutralization.

23. The method of claim 22, wherein the first quantity of white liquor provides between 13% and 25% of the total effective alkali charge applied during neutralization.

24. The method of claim 21, wherein the first quantity of cold caustic extraction alkaline filtrate has an effective alkali level of between 50 and 75 grams NaOH per liter.

25. The method of claim 21, wherein the first quantity of cold caustic extraction alkaline filtrate has an effective alkali level of between 60 and 68 grams NaOH per liter.

26. The method of claim 25, wherein the first quantity of cold caustic extraction alkaline filtrate is enriched with white liquor.

27. The method of claim 20, wherein the second quantity of cold caustic extraction alkaline filtrate has an effective alkali level of between 50 and 75 grams NaOH per liter.

28. The method of claim 27, wherein the second quantity of cold caustic extraction alkaline filtrate has an effective alkali level of between 60 and 68 grams NaOH per liter.

29. The method of claim 27, wherein the second quantity of cold caustic extraction alkaline filtrate is enriched with white liquor.

30. The method of claim 20, wherein the hot black liquor comprises at least half of the total cooking fluid.

31. The method of claim 20, wherein the hot black liquor has an effective alkali level of between 38 and 50 grams NaOH per liter.

32. The method of claim 20, wherein the hot black liquor has an effective alkali level of between 40 and 45 grams NaOH per liter.

33. The method of claim 32, wherein the hot black liquor is enriched with white liquor or cold caustic extraction alkaline filtrate.

34. The method of claim 20, wherein after the cooked pulp is subject to a cold caustic extraction (CCE) stage, a purified pulp is yielded having an alpha content exceeding 97%.

35. The method of claim 20, wherein the cooked pulp has a kappa number of between 8 and 12.

36. The method of claim 18, wherein the pulp-containing organic materials comprise Eucalyptus.

37. A method used in connection with a kraft process for producing dissolving pulp, comprising:

placing lignocellulose material in a reaction vessel and performing pre-hydrolysis;

adding neutralization fluid to the reaction vessel, the neutralization fluid comprising (i) a first quantity of white liquor as a pad having an effective alkali level of between 100 and 130 grams NaOH per liter to partially fill available space in the reaction vessel from the bottom, and (ii) a first quantity of a different solution introduced after the first quantity of white liquor and including an alkaline filtrate having an effective alkali level of between 60 and 68 grams NaOH per liter, the first quantity of white liquor comprising between 10% and 30% of the total effective alkali charge in carrying out neutralization with the neutralization fluid;

displacing the neutralization fluid in the reaction vessel with a cooking fluid comprising a hot black liquor having an effective alkali level of between 30 and 50 grams NaOH per liter and a cold caustic extraction alkaline filtrate having an effective alkali level of between 50 and 75 grams NaOH per liter, the cold caustic extraction alkaline filtrate not having been first treated to decompose or remove hemicelluloses;

cooking the pulp-containing organic material in the reaction vessel; and discharging the cooked pulp from the reaction vessel, the cooked pulp having a residual hemicelluloses content of 3.1% or less as measured in terms of S18 solubility.

38. The method of claim 37, wherein the lignocellulose material comprises hard wood.

39. The method of claim 37, wherein a temperature of the reaction vessel during cooking is between 150 and 153 degrees Celsius.

40. The method of claim 37, wherein the cooked pulp has a kappa number greater than 8.0.

41. The method of claim 37, wherein the cooking fluid is enriched with white liquor.

42. The method of claim 37, wherein the lignocellulose material comprises Eucalyptus.

* * * * *